US008019270B2

(12) United States Patent
Fujii et al.

(10) Patent No.: US 8,019,270 B2
(45) Date of Patent: Sep. 13, 2011

(54) BOOKBINDING APPARATUS AND BOOKBINDING SYSTEM

(75) Inventors: Takayuki Fujii, Toshima-ku (JP); Manabu Yamauchi, Kashiwa (JP); Naoto Watanabe, Kashiwa (JP); Shunsuke Nishimura, Toride (JP); Yushi Oka, Abiko (JP); Toshiyuki Miyake, Toride (JP); Takashi Yokoya, Kashiwa (JP)

(73) Assignee: Canon Kabushiki Kaisha (JP)

( * ) Notice: Subject to any disclaimer, the term of this patent is extended or adjusted under 35 U.S.C. 154(b) by 844 days.

(21) Appl. No.: 11/468,361

(22) Filed: Aug. 30, 2006

(65) Prior Publication Data

US 2007/0048109 A1 Mar. 1, 2007

(30) Foreign Application Priority Data

Aug. 31, 2005 (JP) ..... 2005-252342

(51) Int. Cl.
*B42C 11/02* (2006.01)
*B65H 37/02* (2006.01)

(52) U.S. Cl. ..... 399/408; 39/85

(58) Field of Classification Search ..... 399/85, 399/408; 156/908; *B42C 11/02; B65H 37/02*
See application file for complete search history.

(56) References Cited

U.S. PATENT DOCUMENTS

| | | | | |
|---|---|---|---|---|
| 5,241,349 | A * | 8/1993 | Nagasaka | 399/70 |
| 6,213,456 | B1 * | 4/2001 | Hirano et al. | 270/58.08 |
| 2004/0194894 | A1 * | 10/2004 | Takagi et al. | 156/546 |
| 2006/0029445 | A1 * | 2/2006 | Nakamura et al. | 399/329 |

FOREIGN PATENT DOCUMENTS

| | | | |
|---|---|---|---|
| JP | 11-146103 | A | 5/1999 |
| JP | 2001-71661 | A | 3/2001 |
| JP | 2004-223951 | A | 8/2004 |

* cited by examiner

*Primary Examiner* — Daniel J Colilla
*Assistant Examiner* — Jennifer Simmons
(74) *Attorney, Agent, or Firm* — Rossi, Kimms & McDowell LLP

(57) ABSTRACT

A binding apparatus which can meet user requests and adapt to usage conditions by a user. An adhesive is heated and melted, and then applied to a sheet bundle to bind the sheet bundle. One of the following modes is selected: a first adhesive temperature adjusting mode in which the adhesive is heated when power supply to the bookbinding apparatus is turned on, and a second adhesive temperature adjusting mode in which the adhesive is heated when binding of the sheet bundle is started.

6 Claims, 36 Drawing Sheets

*FIG. 40*

PLEASE PLACE ORIGINALS ON ORIGINAL FEEDER

END SETTING

*FIG. 41*

READ ORIGINAL WHICH IS TO BE GLUED-ON COVER

PLEASE PLACE ORIGINAL WHICH IS
TO BE GLUED-ON COVER ON ORIGINAL
FEEDER AND PRESS START BUTTON

CANCEL

BOOKBINDING APPARATUS AND BOOKBINDING SYSTEM

BACKGROUND OF THE INVENTION

1. Field of the Invention

The present invention relates to a bookbinding apparatus and a bookbinding system which adjust the temperature of glue used in bookbinding.

2. Description of the Related Art

Conventionally, there has been known a bookbinding apparatus which heats solid glue into liquid form using a heater or the like, coats the liquid glue to one side edge of a sheet bundle, and binds the sheet bundle (see Japanese Laid-Open Patent Publication (Kokai) No. 2001-71661). Such a bookbinding apparatus has the advantage that a larger number of sheets can be bound into a booklet as compared with bookbinding apparatuses of the type using a staple, and hence originals consisting of a small number of pages up to a large number of pages can be bound.

In the bookbinding apparatus disclosed in Japanese Laid-Open Patent Publication (Kokai) No. 2001-71661, however, a heater has to continuously heat glue to a predetermined temperature in excess of the temperature at which glue is melted so that glue liquefied once can be kept in a liquid state. If the temperature of glue is continuously controlled to the predetermined temperature, power is consumed even when the bookbinding apparatus is not operating, and hence the bookbinding apparatus cannot meet user requests for reduction of power consumption and adapt to usage conditions by a user.

On the other hand, if the bookbinding apparatus is configured to control the temperature of glue only when it is operating, power consumption can be suppressed, but if glue is solidified, it takes time for the glue to be liquefied again, and hence it is necessary to wait for a long time until a finished book is output. In this case, the bookbinding apparatus cannot meet user requests for quick output of a finished book and adapt to usage conditions by a user.

SUMMARY OF THE INVENTION

It is an object of the present invention to provide a binding apparatus and a binding system which can meet user requests and adapt to usage conditions by a user.

To attain the above object, in a first aspect of the present invention, there is provided a bookbinding apparatus connectable to an image forming apparatus, comprising a heating unit that heats an adhesive, a bookbinding unit that applies the adhesive melted by the heating unit to a sheet bundle to bind the sheet bundle, and a selection unit that selects one of a first adhesive temperature adjusting mode in which the heating unit heats the adhesive when power supply to the bookbinding apparatus is turned on and a second adhesive temperature adjusting mode in which the heating unit heats the adhesive when binding of the sheet bundle is started.

With the arrangement of the first aspect of the present invention, it is possible to select either of the first adhesive temperature adjusting mode in which the heating unit is caused to heat glue when power supply to the bookbinding apparatus is turned on, and the second adhesive temperature adjusting mode in which the heating unit is caused to heat glue when binding of a sheet bundle is started. Namely, the user can determine whether waiting time until a finished book is output is to be reduced by continuously adjusting the temperature of glue or power consumption is to be suppressed by not adjusting the temperature of glue before bookbinding is started, and therefore it is possible to meet user requests and adapt to usage conditions by a user.

Preferably, the image forming apparatus lies in any of the following states: an operating state in which an image forming operation is being carried out, a standby state in which the image forming operation is not being carried out, and a sleep state in which power consumption during standby before the image forming operation is suppressed, and the bookbinding apparatus further comprises a control unit that controls the heating unit to heat the adhesive when the selection unit selects the first adhesive temperature adjusting mode and the image forming apparatus lies in the operating state or the standby state, and controls the heating unit to stop heating the adhesive when the selection unit selects the first adhesive temperature adjusting mode and the image forming apparatus lies in the sleep state.

More preferably, the bookbinding apparatus further comprises a control unit that controls the heating unit to heat the adhesive when the selection unit selects the second adhesive temperature adjusting mode and the image forming apparatus lies in the operating state, and controls the heating unit to stop heating the adhesive when the selection unit selects the second adhesive temperature adjusting mode and the image forming apparatus lies in the standby state or the sleep state.

Preferably, the bookbinding unit applies the adhesive to one side edge of the sheet bundle and bonds a sheet that is about twice as large as the sheet bundle to the one side edge of the sheet bundle to which the adhesive has been applied, to bind the sheet bundle.

To attain the above object, in a second aspect of the present invention, there is provided a bookbinding system comprising an image forming apparatus and a bookbinding apparatus, the bookbinding system comprising the bookbinding apparatus comprising a sheet stacking unit that sequentially receives sheets on which images have been formed by the image forming apparatus and stacks the sheets, a heating unit that heats an adhesive, and a bookbinding unit that applies the adhesive melted by the heating unit to a sheet bundle comprising a plurality of sheets stacked on the sheet stacking unit to bind the sheet bundle, and the image forming apparatus comprising an image forming unit that forms an image on a sheet, and a selection unit that selects one of a first adhesive temperature adjusting mode in which the heating unit heats the adhesive when power supply to the bookbinding apparatus is turned on and a second adhesive temperature adjusting mode in which the heating unit heats the adhesive when binding of the sheet bundle is started.

Preferably, the image forming apparatus lies in any of the following states: an operating state in which an image forming operation is being carried out, a standby state in which the image forming operation is not being carried out, and a sleep state in which power consumption during standby before the image forming operation is suppressed, and the image forming apparatus comprises a control unit that controls the heating unit to heat the adhesive when the selection unit selects the first adhesive temperature adjusting mode and the image forming apparatus lies in the operating state or the standby state, and controls the heating unit to stop heating the adhesive when the selection unit selects the first adhesive temperature adjusting mode and the image forming apparatus lies in the sleep state.

More preferably, the heating unit is controlled to heat the adhesive when the selection unit selects the second adhesive temperature adjusting mode and the image forming apparatus lies in the operating state, and the heating unit is controlled to stop heating the adhesive when the selection unit selects the second adhesive temperature adjusting mode and the image forming apparatus lies in the standby state or the sleep state.

Preferably, the bookbinding unit applies the adhesive to one side edge of the sheet bundle and bonds a sheet that is about twice as large as the sheet bundle to the one side edge of the sheet bundle to which the adhesive has been applied, to bind the sheet bundle.

The above and other objects, features, and advantages of the invention will become more apparent from the following detailed description taken in conjunction with the accompanying drawings.

BRIEF DESCRIPTION OF THE DRAWINGS

FIG. 40 is a view showing an example of a screen view for prompting a user to place originals on an original feeder.

FIG. 41 is a view showing an example of a screen view for prompting the user to place an original which is to be a glued-on cover on the original feeder.

DETAILED DESCRIPTION OF THE PREFERRED EMBODIMENTS

The present invention will now be described in detail with reference to the drawings showing a preferred embodiment thereof.

Figure 1:
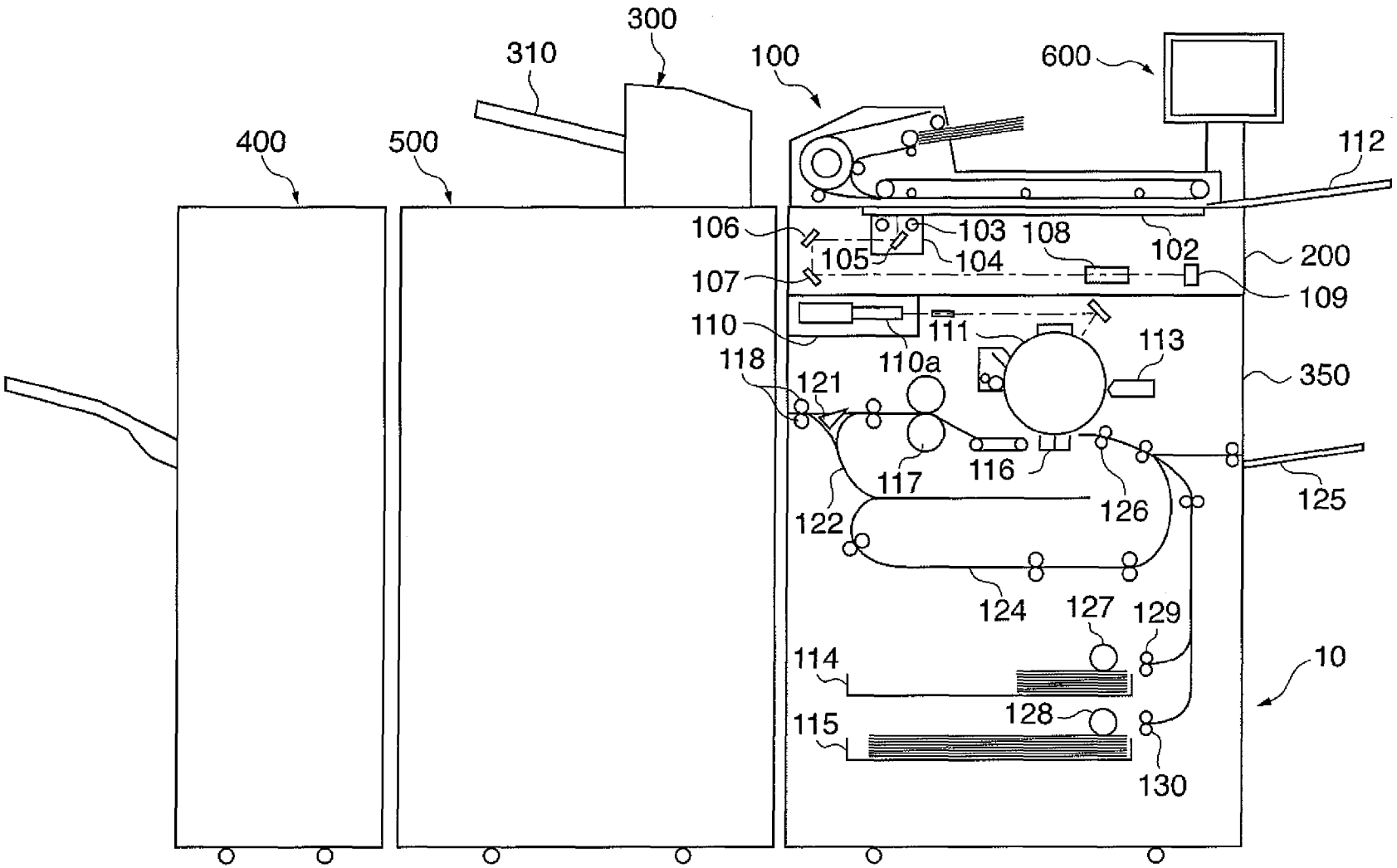
FIG. 1 is a diagram showing the construction of a bookbinding system according to an embodiment of the present invention.

FIG. 1 is a diagram showing the construction of a bookbinding system according to an embodiment of the present invention.

As shown in FIG. 1, the bookbinding system is comprised of an image forming apparatus 10, a gluing bookbinding apparatus 500, and a finisher 400 which is a postprocessing apparatus. The image forming apparatus 10 is comprised of an image reader 200 which reads an image on an original and a printer 350 which forms the read image on a sheet. The image forming apparatus 10 is further comprised of an operation display device 600 which includes a plurality of keys for setting various functions concerned with image formation, a display unit for displaying information indicative of settings, and so forth.

An original feeder 100 is mounted on the image reader 200. The original feeder 100 feeds originals, which are placed on an original tray with surfaces thereof on which images are formed facing upward, one by one from the first page and causes each original to pass through a moving original reading position on a platen glass 102 via a curved path. Further, the original feeder 100 discharges the original having passed through the moving original reading position onto an external discharge tray 112.

When an original passes through the moving original reading position on the platen glass 102, an image on the original is read by a scanner unit 104 held at a position corresponding to the moving original reading position. This reading method is generally referred to as moving original reading. Specifically, when an original passes through the moving original reading position, the original is illuminated by light from a lamp 103 of the scanner unit 104, and reflected light from the original is guided to a lens 108 through mirrors 105, 106, and 107. The light having passed through the lens 108 forms an image on an image pickup surface of an image sensor 109.

As described above, by conveying an original in such a manner that the original passes through the moving original reading position, scanning-in is carried out in which a direction perpendicular to the original conveying direction is a main scanning direction and the original conveying direction is a sub-scanning direction. Namely, when an original passes through the moving original reading position, an image on the original is read by the image sensor 109 in the main scanning direction and line by line while the original is being conveyed in the sub-scanning direction, so that the entire image on the original is read. The original image optically read by the image sensor 109 is converted into image data by the same for output to an image signal control section 202, referred to hereinafter. The image data output from the image sensor 109 is subjected to predetermined processing by the image signal control section 202, and then discharged as a video signal to an exposure control section 110 of the printer 350.

It may be configured such that the original feeder 100 conveys an original onto the platen glass 102 and stops the original at a predetermined position, and in this state, the scanner unit 104 reads the original by scanning it in a direction from left to right. This reading method is generally referred to as stationary original reading.

In reading an original without using the original feeder 100, first, the user raises the original feeder 100, places the original on the platen glass 102, and causes the scanner unit 104 to scan the original in a direction from left to light. Namely, in reading an original without using the original feeder 100, the stationary original reading is carried out.

The exposure controller 110 of the printer 350 modulates a laser beam based on the video signal input from the image reader 200 and outputs the same. The laser beam is irradiated onto a photosensitive member 111 while being scanned by a polygon mirror 100*a*. An electrostatic latent image corresponding to the scanned laser beam is formed on the photosensitive member 111. Here, in the stationary original reading, the exposure controller 110 outputs a laser beam in such a manner that a correct image (i.e. an image which is not a mirror image) is formed. The electrostatic latent image on the photosensitive drum 111 is visualized as a toner image by toners supplied from a developing unit 113.

On the other hand, a sheet fed by a pickup roller 127 or 128 from an upper cassette 114 or a lower cassette 115 provided in the printer 350 is conveyed up to resist rollers 126 via sheet feed rollers 129 or 130. When the leading end of the sheet reaches the resist rollers 126, the resist rollers 126 are driven in arbitrary timing, and the sheet is conveyed to a position between the photosensitive drum 111 and a transfer section 116 in synchronization with timing in which the irradiation of the laser beam is started. The toner image formed on the photosensitive drum 111 is transferred onto the fed sheet by the transfer section 116. The sheet onto which the toner image has been transferred is conveyed to a fixing unit 117. The fixing unit 117 fixes the toner image onto the sheet by applying thermal pressure to the toner image. The sheet onto which the toner image has been fixed by the fixing unit 117 is guided via a flapper 121 and discharge rollers 118 and then discharged from the printer 350 to the outside of the image forming apparatus 10 (i.e. the gluing bookbinding apparatus 500).

Here, in discharging the sheet to the gluing bookbinding apparatus 500 with a surface thereof on which the toner image is formed facing downward, the sheet onto which the toner image has been fixed by the fixing unit 117 is guided once to a sheet inverting path 122 by a switching action of the flapper 121. After the trailing end of the sheet passes the flapper 121, the sheet is switched pack and discharged from the printer 350 to the gluing bookbinding apparatus 500 by the discharge rollers 118. This discharge mode is referred to as inverted discharge. The inverted discharge is carried out in sequentially forming images from the first page as in the case of forming images read using the original feeder 100 or forming images output from a computer, not shown, and the sheets discharged in the inverted discharge are arranged in their proper sequence.

A hard sheet such as an OHP sheet is fed from a manual sheet feed section 125. The sheet on which an image has been formed is discharged to the gluing bookbinding apparatus 500 by the discharge rollers 118 with a surface on which the image is formed facing upward.

Further, in the case where a double-sided copy mode in which images are formed on both sides of a sheet is designated, a sheet is guided to the sheet inverting path 122 by a switching action of the flapper 121 and then conveyed to a double-sided conveying path 124. The sheet conveyed to the double-sided conveying path 124 is fed again to the position between the photosensitive drum 111 and the transfer section 116 in the above-mentioned timing.

Figure 2:
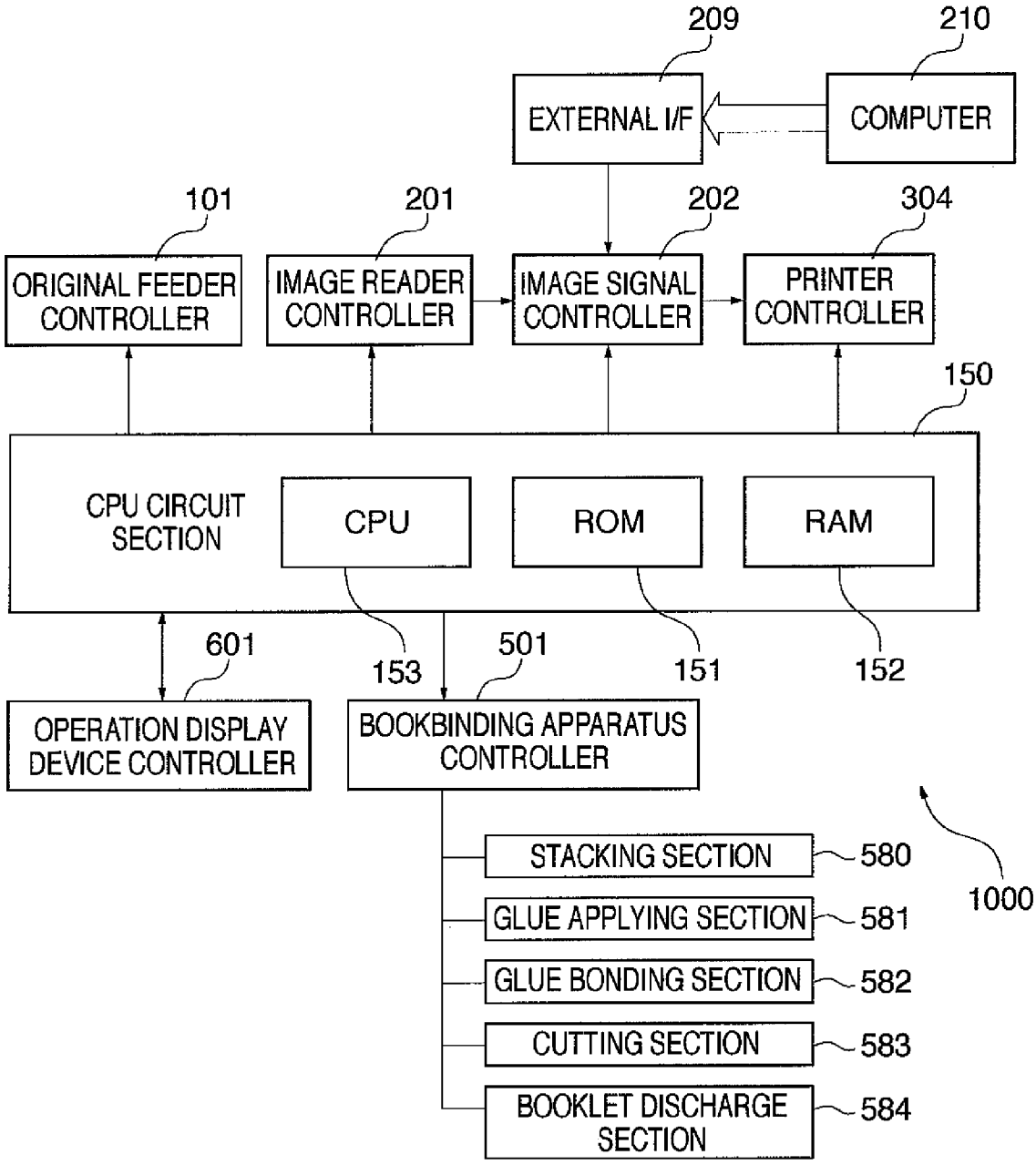
FIG. 2 is a block diagram showing the configuration of a controller that controls the entire bookbinding system in FIG. 1.

FIG. 2 is a block diagram showing the construction of a controller 1000 which controls the entire bookbinding system in FIG. 1.

The controller 1000 is included in the image forming apparatus 10 appearing in FIG. 1. The controller 1000 includes a CPU circuit section 150, which has a CPU 153, a ROM 151, and a RAM 152 incorporated therein and controls the overall operation of blocks 101, 201, 202, 209, 304, 601, and 501 in accordance with control programs stored in the ROM 151. The RAM 152 temporarily stores control data and also serves as a working area for computations related to control.

The original feeder controller 101 drivingly controls the original feeder 100 in accordance with instructions from the CPU circuit section 150. The image reader controller 201 drivingly controls the scanner unit 104, the image sensor 109, and so forth described above and transfers an analog image signal output from the image sensor 109 to the image signal controller 202.

After converting the analog image signal transferred from the image sensor 109 into a digital signal, the image signal controller 202 performs various kinds of processing on the digital signal and converts the digital signal into a video signal and outputs the same to the printer controller 304. The image signal controller 202 also performs various kinds of processing on a digital image signal input from a computer 210 via the external I/F 209, converts the digital image signal into a video signal, and outputs the same to the printer controller 304. The processing performed by the image signal controller 202 is controlled by the CPU circuit section 150. The printer controller 304 drives the exposure controller 110 described above in accordance with the input video signal.

The bookbinding apparatus controller 501 is connected to a sheet stacking section 580, a glue applying section 581, a glue bonding section 582, a cutting section 583, and a booklet discharge section 584, described hereinafter. The bookbinding apparatus controller 501 controls the overall operation of the component elements of the bookbinding apparatus 500 including the sheet stacking section 580, glue applying section 581, glue bonding section 582, cutting section 583, and booklet discharge section 584 in accordance with signals from the CPU circuit section 150. The bookbinding apparatus controller 501 is included in the image forming apparatus 100, but may alternatively be included in the gluing bookbinding apparatus 500.

The operation display device controller 601 exchanges information between the operation display device 600 and the CPU circuit section 150. The operation display device 600, which has the plurality of keys for setting various functions concerned with image formation, the display unit for displaying information indicative of settings, and so forth, outputs a key signal corresponding to operation of each key to the CPU circuit section 150. Also, in accordance with a signal from the CPU circuit section 150, the operation display device 600 displays corresponding information on the display unit.

Figure 3:
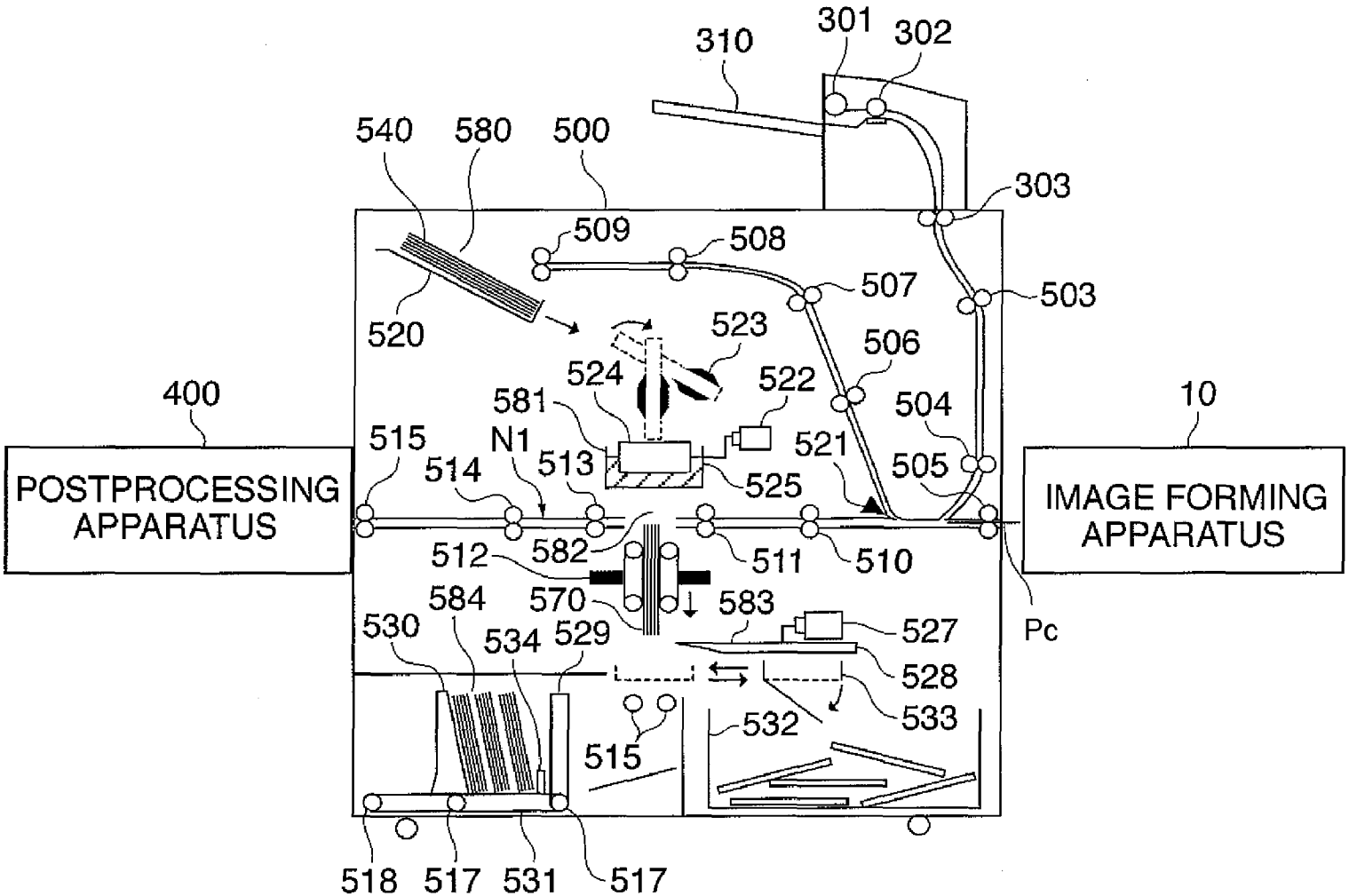
FIG. 3 is a sectional view showing the inner construction of a gluing bookbinding apparatus appearing in FIG. 1.

FIG. 3 is a sectional view showing the internal construction of a gluing bookbinding apparatus 500 appearing in FIG. 1.

The gluing bookbinding apparatus 500 is comprised mainly of the following component elements for use in a bookbinding mode: the sheet stacking section 580 that stacks sheets discharged from the image forming apparatus to form a sheet bundle, the glue applying section 581 that applies glue to the sheet bundle, the glue bonding section 582 that bonds the sheet bundle with the glue applied thereto and a cover together, and the cutting section 583 that cuts three sides of the sheet bundle other than the side to which the glue has been applied so as to align an end face of the sheet bundle with the cover glued thereto, and the booklet discharge section 584 that discharges a finished booklet. Also, the gluing bookbinding apparatus 500 is connected to the image forming apparatus 10 via a connection unit 590. The connection unit 590 includes a communication line for carrying out communication of control signals and various data between the gluing bookbinding apparatus 500 and the image forming apparatus 10.

Next, a description will be given of the procedure of a bookbinding sequence.

In the bookbinding mode, the sheet stacking section 580 stacks sheets discharged from the image forming apparatus 10 on a sheet stacking tray 520 to form a sheet bundle 540. The sheet bundle 540 formed by the sheet stacking section 580 is conveyed to the glue applying section 581, in which glue is applied to one side edge (lower side as viewed in FIG. 3) of the sheet bundle 540 by an adhesive container 525, a glue applying roller 524, and a glue applying roller control motor 522.

The glue bonding section 582 bonds the sheet bundle 540 with the glue applied thereto to a cover Pc (explained in detail hereafter with reference to FIG. 6) discharged from the image forming apparatus 10 and transfers the resultant sheet bundle in the form of a booklet 570 to a trim gripper 512. The booklet 570 is then conveyed to the cutting section 583 by the trim gripper 512. In the cutting section 583, a cutter 528 is caused to move in a horizontal direction by a cutter control motor 527 to cut the booklet 570. Cutting wastage falls into a waste receiving box 533, and when a cutting sequence is completed, the cutting wastage is collected in a waste box 532. The booklet 570 for which cutting has been completed by the cutting section 583 is conveyed from the cutting section 583 to the booklet discharge section 584 and discharged from the gluing bookbinding apparatus 500.

Although the bookbinding sequence in the bookbinding mode has been described above, a normal discharge mode in which sheets are discharged without carrying out bookbinding may be selected instead of the bookbinding mode.

A switching flapper 521 is disposed downstream of a pair of conveying rollers 505. The switching flapper 521 is intended to selectively guide a sheet conveyed by the conveying rollers 505 to the sheet stacking tray 520 or the postprocessing apparatus 400.

In the normal discharge mode, sheets P discharged from the image forming apparatus 10 are discharged to the postprocessing apparatus 400 by pairs of conveying rollers 505, 510, 511, 513, and 514 and a pair of sheet-discharging rollers 515. For example, in the postprocessing apparatus 400 such as a finisher, processing of the sheets P in the form of a bundle, i.e. postprocessing such as bundle-discharging, binding, folding, and bookbinding can be performed on the sheets P.

On the other hand, in the bookbinding mode, the sheets P discharged from the image forming apparatus 10 are discharged onto the above-mentioned sheet stacking tray 520 by pairs of conveying rollers 506, 507, and 508 and a pair of stacking section discharging rollers 509 and aligned into the sheet bundle 540.

Referring next to FIGS. 4 to 7, a description will be given of the flow of a sheet in the gluing bookbinding apparatus 500.

Figure 4:
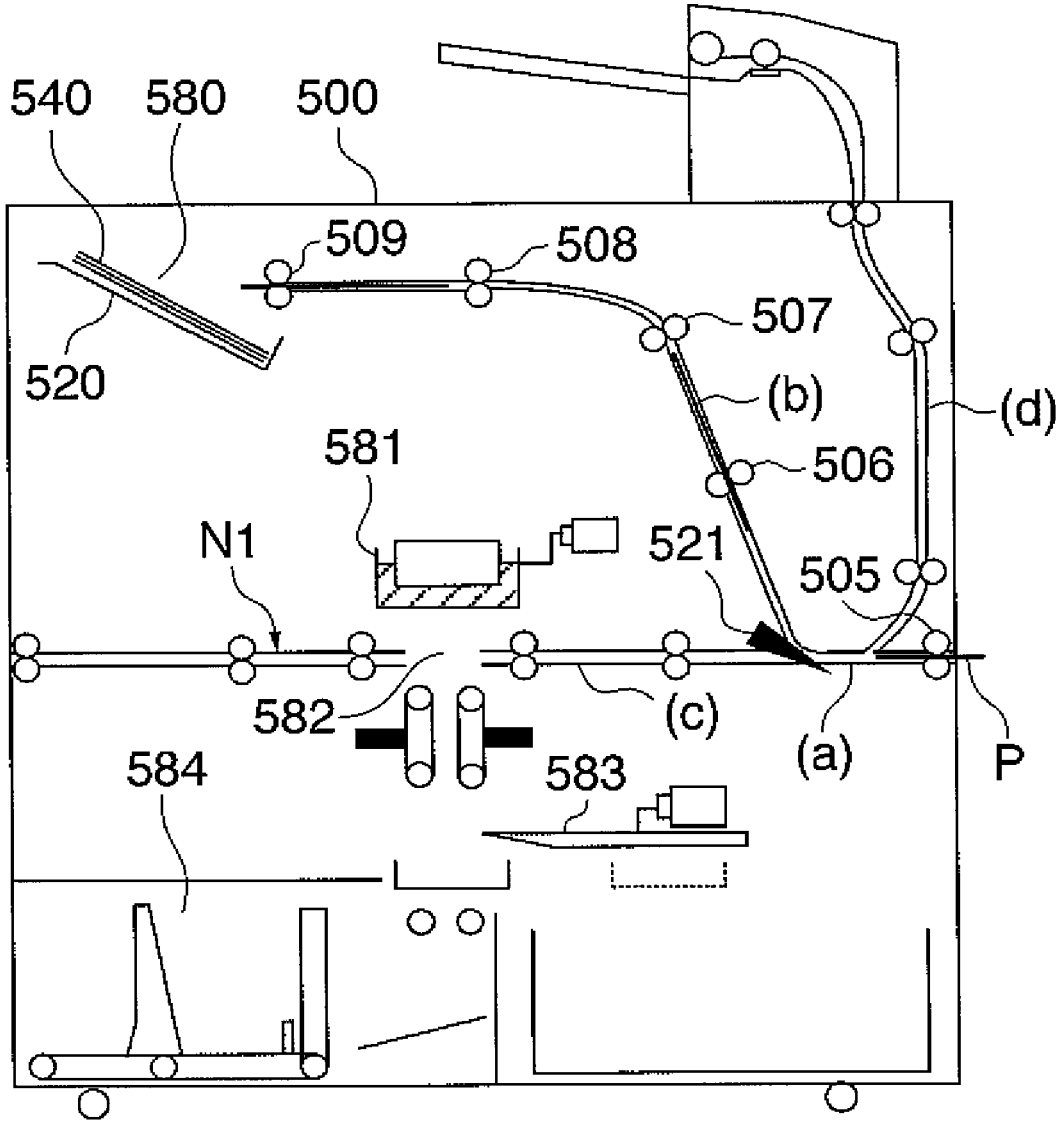
FIG. 4 is a view useful in explaining how an inner sheet, i.e., a sheet other than a cover sheet moves in the gluing bookbinding apparatus.
Figure 5:
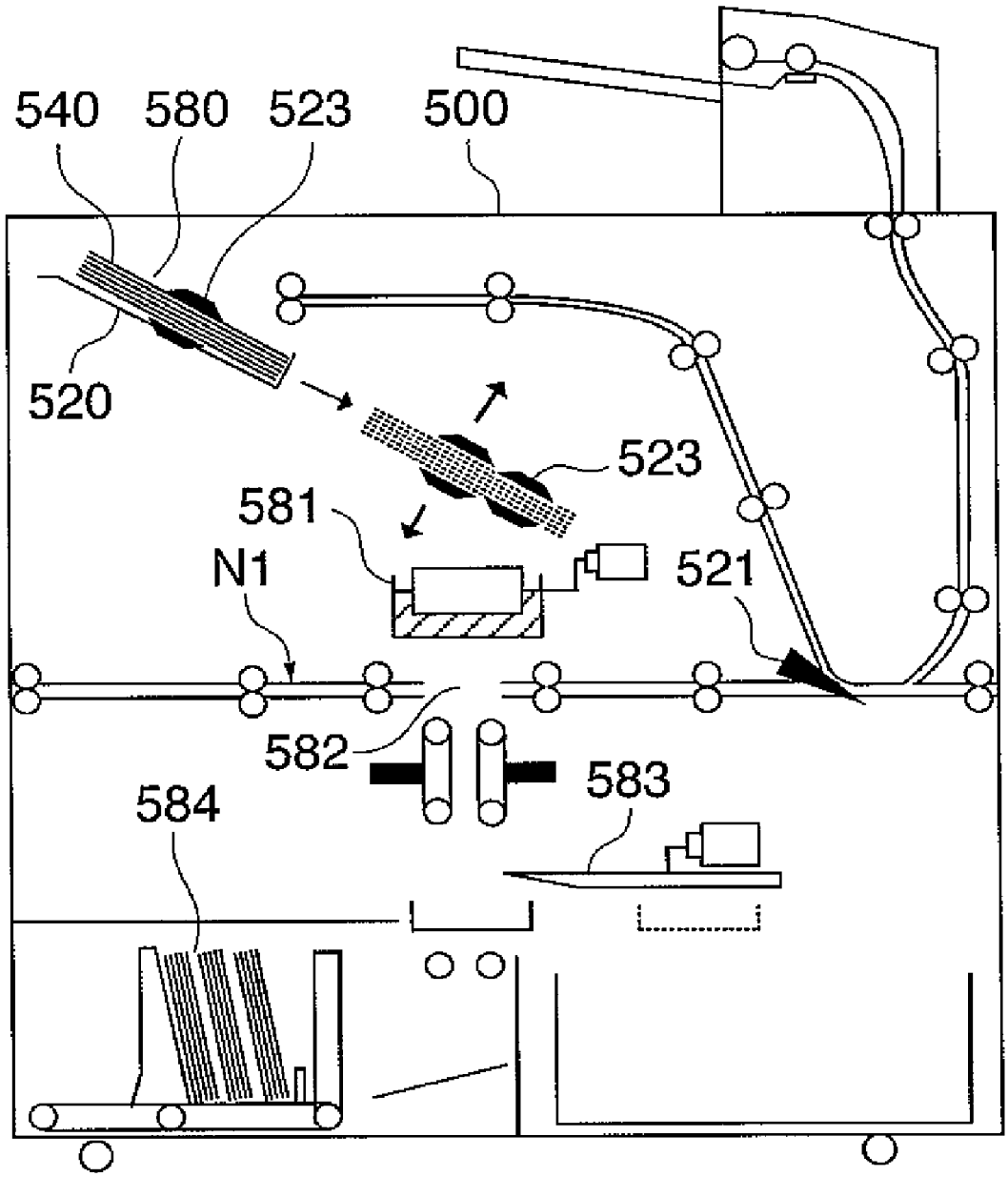
FIG. 5 is a view useful in explaining how a bundle of inner sheets moves in the gluing bookbinding apparatus.

As shown in FIG. 4, the gluing bookbinding apparatus 500 captures a sheet P discharged from the image forming apparatus 10 via the conveying rollers 505 and guides the sheet P to a conveying path (a). If the sheet P is an inner sheet (i.e. sheet other than a cover) for a sheet bundle, the sheet P taken in by the conveying rollers 505 is guided to a conveying path (b) by the switching flapper 521 and conveyed by the conveying rollers 506, 507, 508, and 509. The sheet P is discharged from the conveying rollers 509 onto the sheet stacking tray 520. When all the sheets which are to be inner sheets are discharged onto the sheet stacking tray 520, a sheet bundle 540 of the inner sheets is gripped by a glue applying gripper 523 as shown in FIG. 5 and moved from the sheet stacking section 580 to a location above the glue applying section 581 as indicated by broken lines in FIG. 5.

Figure 6:
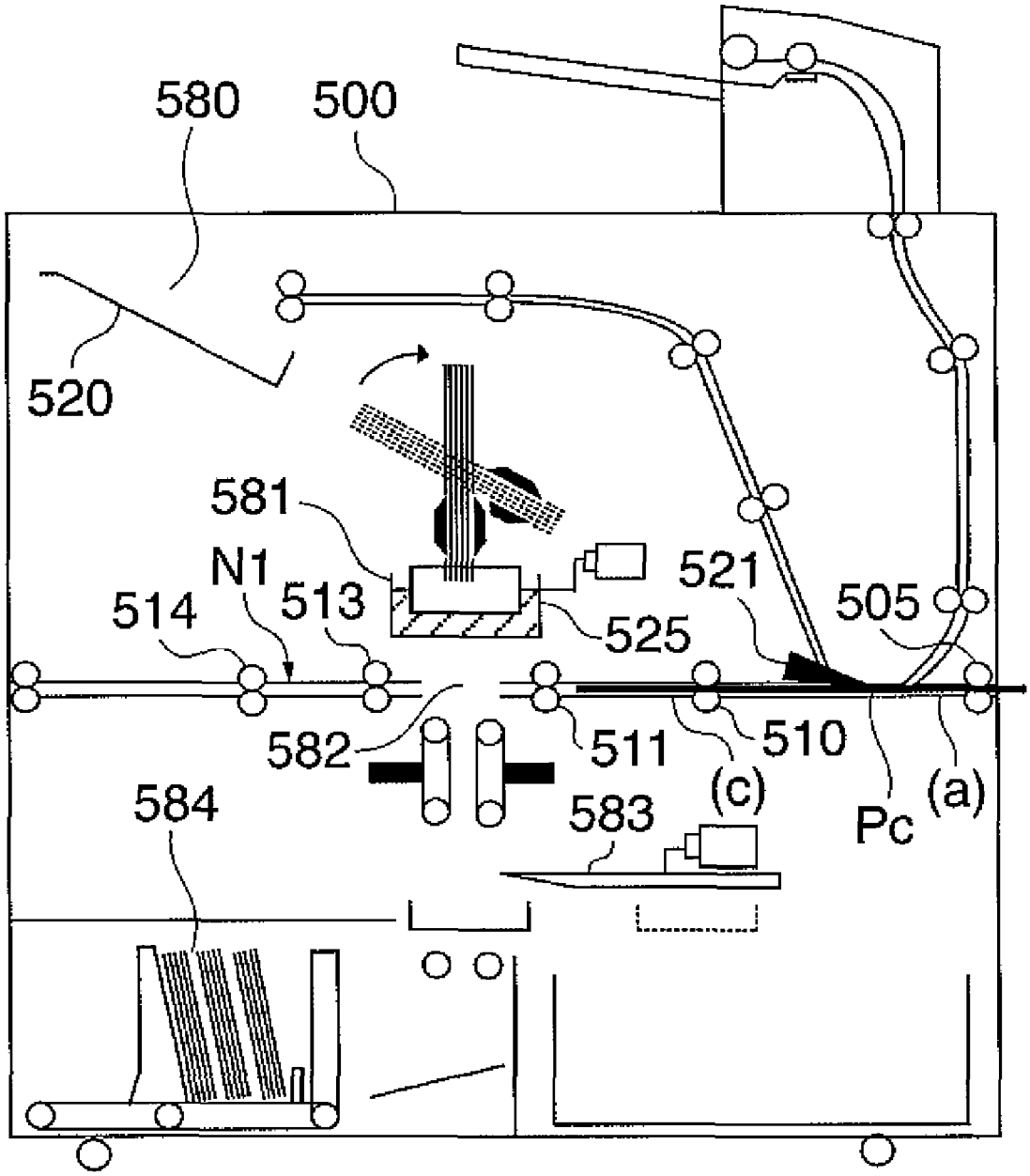
FIG. 6 is a view useful in explaining how the bundle of inner sheets and a cover move in the gluing bookbinding apparatus.
Figure 7:
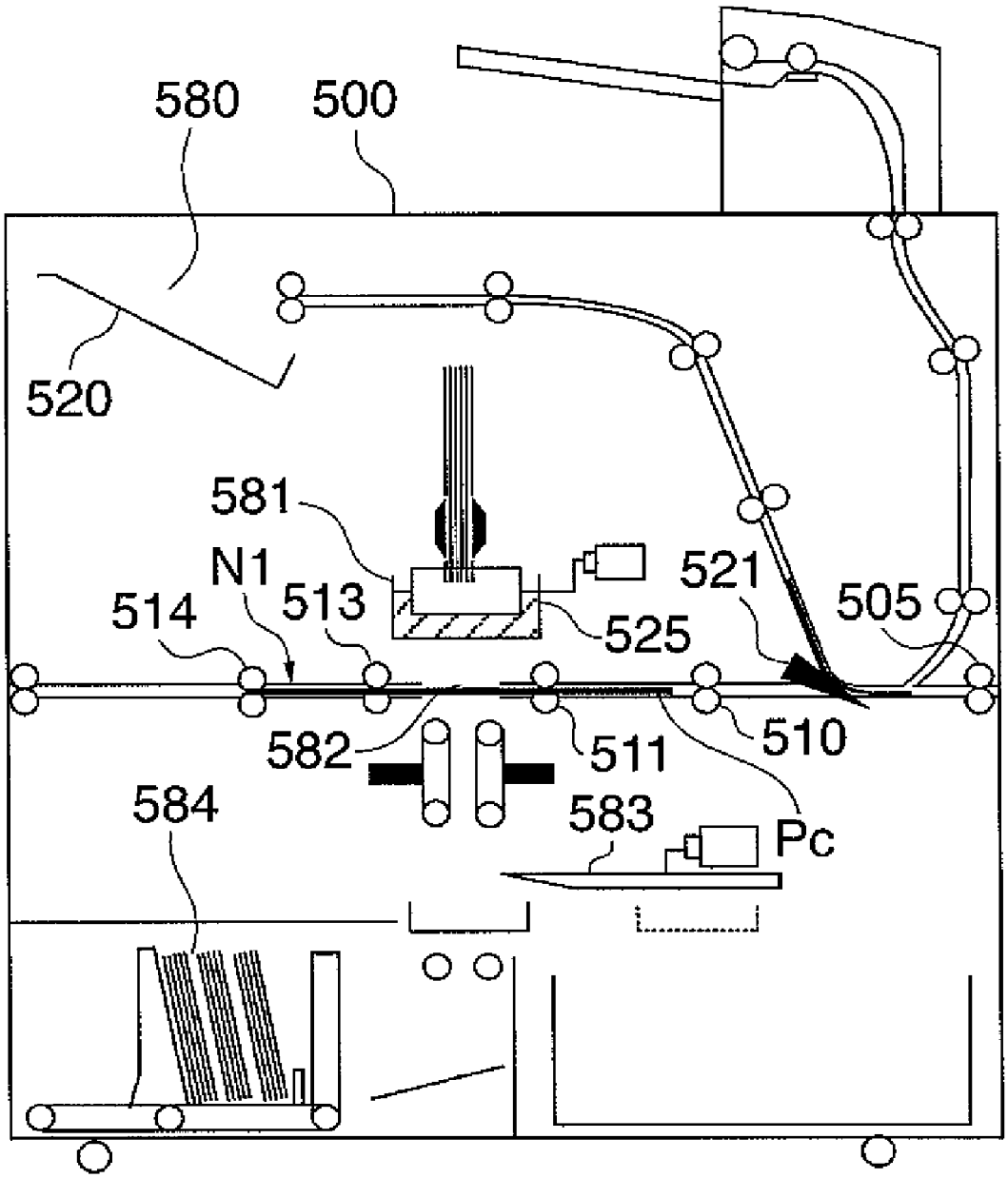
FIG. 7 is a view useful in explaining how the bundle of inner sheets and the cover move in the gluing bookbinding apparatus.

The sheet bundle 540 having moved to the location above the glue applying section 581 is rotated so that it can be vertical in the state of being gripped by the glue applying gripper 523 as shown in FIG. 6 and is positioned so that one side edge which is to be a spine of the sheet bundle 540 can be opposed to the glue applying section 581. The glue container 525 and the glue applying roller 524 then move along the one side edge of the sheet bundle 540, so that glue is applied to the sheet bundle 540. In the meantime, a cover Pc is discharged from the image forming apparatus 10 and conveyed to the gluing bookbinding apparatus 500. The cover Pc taken into the gluing bookbinding apparatus 500 is guided from the conveying path (a) to a conveying path (c) by a switching operation of the switching flapper 521 and conveyed by the conveying rollers 510, 511, 513, and 514. On the conveying path (c), a sensor N1 is disposed downstream of the conveying rollers 513; as shown in FIG. 7, the conveyance of the cover Pc for the sheet bundle 540 is stopped when the cover Pc has been conveyed a predetermined distance since the leading end thereof was detected by the sensor N1.

At a time point when the cover Pc stops on the conveying path (c), the trailing end of the cover Pc leaves the switching flapper 521. In the case where the next sheet bundle is subsequently formed, even when the cover Pc lies on the conveying path (c), the switching flapper 521 is switched back to receive an inner sheet for the next sheet bundle from the image forming apparatus 10 and convey the sheet to the sheet stacking tray 520 via the conveying path (a) and the conveying path (b).

After that, the sheet bundle with the glue applied thereto is cased in the cover and conveyed downstream. This will be described later in further detail.

Although in the above described example, a cover is conveyed from the image forming apparatus 10, an inserter 300 is provided at the top of the gluing bookbinding apparatus 500 so that only a cover can be inserted through the inserter 300.

Figure 8:
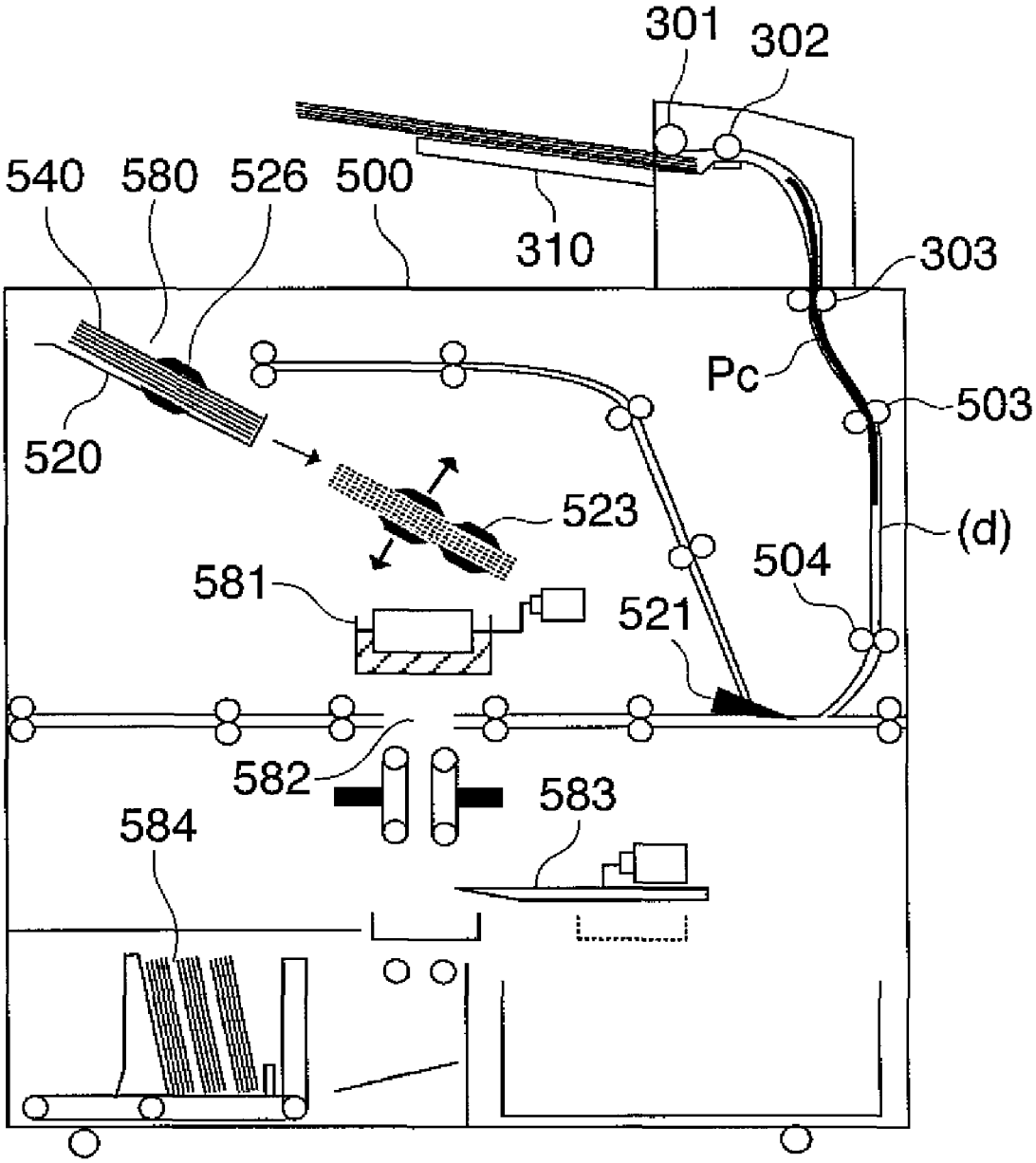
FIG. 8 is a view useful in explaining how a cover moves from an inserter into the gluing bookbinding apparatus.
Figure 9:
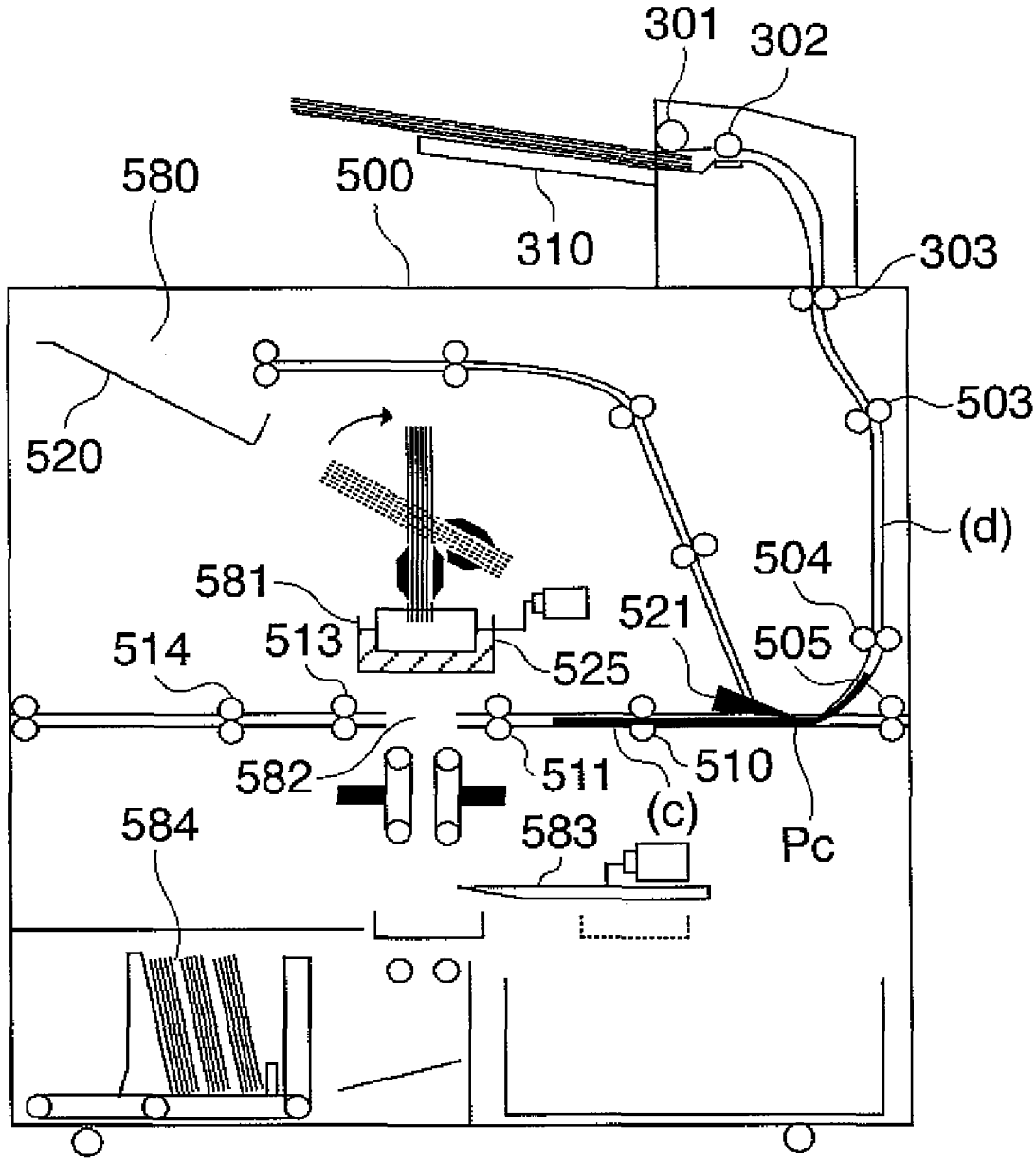
FIG. 9 is a view useful in explaining how the bundle of inner sheets and the cover move in the gluing bookbinding apparatus.

Referring next to FIGS. 8 and 9, a description will be given of the flow of a sheet in the case where a cover is inserted through the inserter 300 in bookbinding.

Regarding the flow of inner sheets, the gluing bookbinding apparatus 500 sequentially takes in sheets discharged from the image forming apparatus 10, conveys the sheets onto the sheet stacking tray 520, and forms a sheet bundle on the sheet stacking tray 520 as described above with reference to FIGS. 4 to 7. The formed sheet bundle as a whole is moved to the glue applying section 581 by the glue applying gripper 523.

In the case where a cover Pc is inserted through the inserter 300, one sheet which is a top one of sheets on a sheet feed tray 310 is fed by sheet feed rollers 301, 302 while a bundle of inner sheets is being moved from the sheet stacking section 580 to the glue applying section 581 as shown in FIG. 8. As shown in FIG. 9, the fed cover Pc is conveyed by pairs of conveying rollers 303, 503, and 504 and guided from a conveying path (d) to the conveying path (c) by the switching flapper 521. Processing performed after the cover Pc is guided to the conveying path (c) is the same as the above described processing, and therefore description thereof is omitted.

Next, a detailed description will be given of processes carried out by the respective component elements of the gluing bookbinding apparatus 500.

Figure 10:
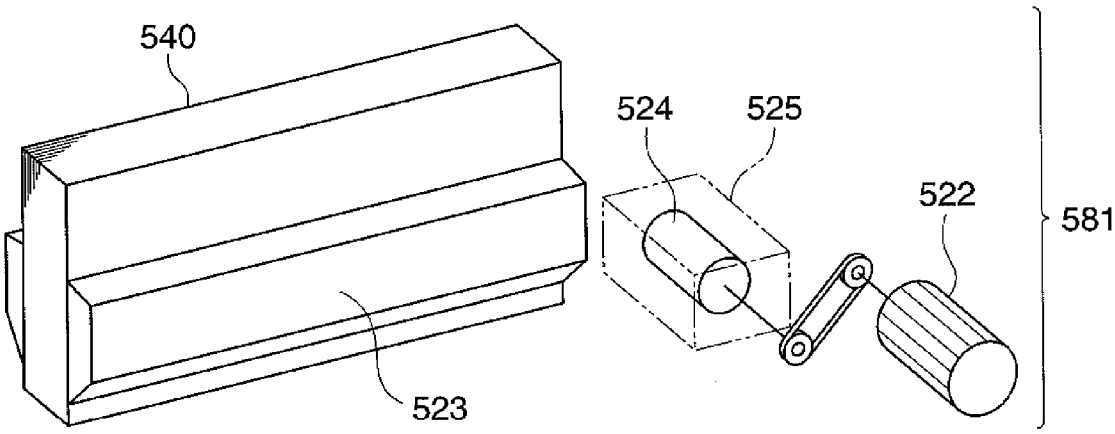
FIG. 10 is a view showing the construction of a glue applying section.
Figure 11:
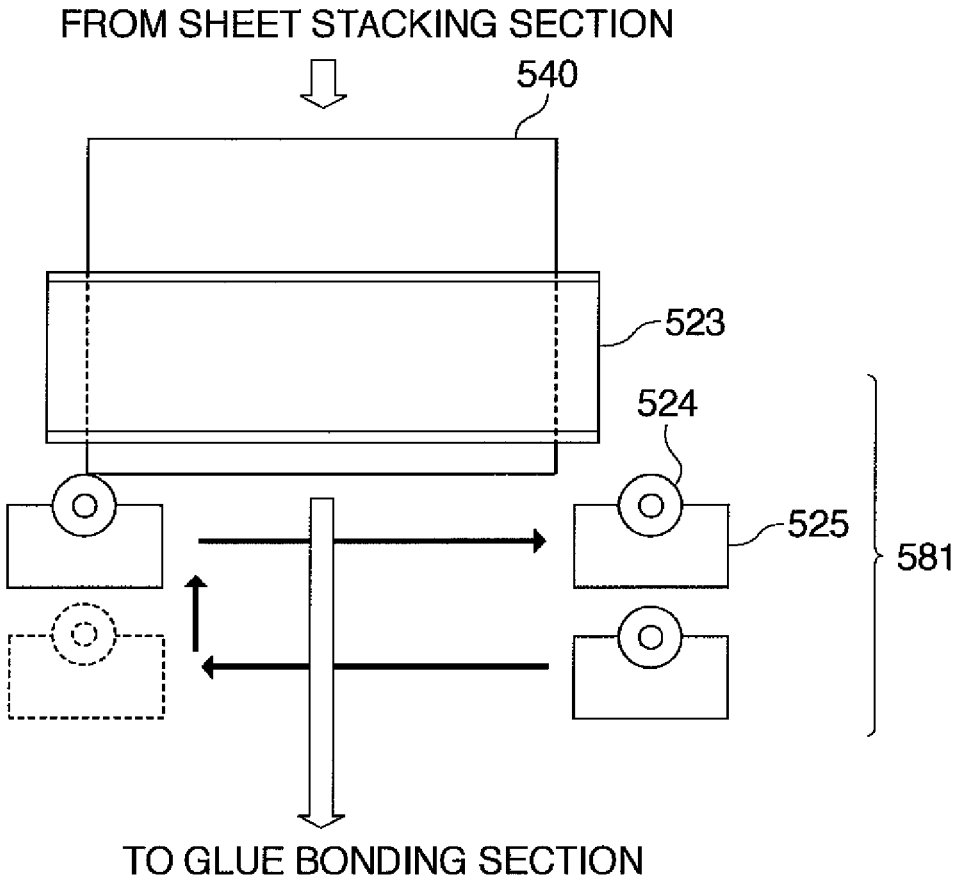
FIG. 11 is a diagram showing the general outline of a glue applying process carried out by the glue applying section.

FIG. 10 is a view showing the construction of the glue applying section 581, and FIG. 11 is a diagram showing the general outline of a glue applying process carried out by the glue applying section 581.

The glue applying section 581 is comprised of the glue applying gripper 523 that grips the sheet bundle 540, the glue applying roller 524 that applies glue to the sheet bundle 540, the glue container 525 that contains glue, and the glue applying roller control motor 522.

The glue applying roller 524 immersed in the glue container 525 is caused to keep rotating by the glue applying roller control motor 522.

A driving means, not shown, causes the glue container 525, glue applying roller 524, and glue applying roller control motor 522 to move in a direction along the length of a lower side edge of the sheet bundle 540 gripped in a standing condition by the glue applying gripper 523 and in a direction parallel to the sheet bundle 540. Their reciprocal motions apply glue to the sheet bundle 540.

As shown in FIG. 11, the glue container 525 and the glue applying roller 524 start moving from an initial position on the back side of the gluing bookbinding apparatus 500 and stop at a predetermined position on the front side of the gluing bookbinding apparatus 500. At this time, the glue is not applied to the lower side edge of the sheet bundle 540 by the glue container 525 and the glue applying roller 524. The glue is applied to the sheet bundle 540 when the glue container 525 and the glue applying roller 524 move from the front side to back side of the gluing bookbinding apparatus 500. The glue container 525 and the glue applying roller 524 standing still at a predetermined position move up to a position where the glue applying roller 524 comes into contact with the lower side edge of the sheet bundle 540. The glue applying roller 524 then applies the glue to the lower side edge of the sheet bundle 540 while the glue container 525 and the glue applying roller 524 are moving from the front side to back side of the gluing bookbinding apparatus 500.

Figure 12:
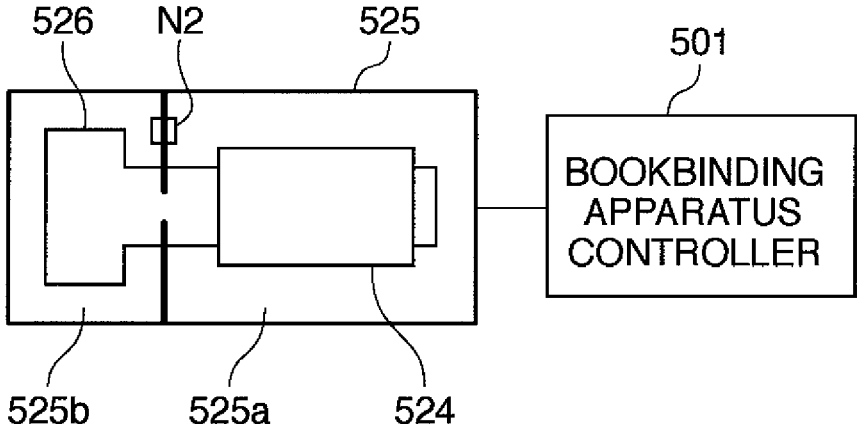
FIG. 12 is a view showing a glue container as viewed from above.

FIG. 12 shows the glue container 525 as viewed from above.

A plate-shaped heater 526 is disposed at the bottom of the glue container 525. The glue container 525 is divided by a partition into a compartment 525*a* in which the glue applying roller 524 is disposed and a compartment 525*b* for replenishing glue. A cut is made in part of the partition. Glue liquefied by the heater 526 is stored in the glue container 525. When the amount of glue in the glue container 525 decreases, the compartment 525*b* is replenished with solid glue, which is then liquefied by the heater 526 and caused to flow from the compartment 525*b* into the compartment 525*a* through the cut made in the partition.

Also, a thermistor N2 for detecting the temperature of glue is provided on the partition that divides the glue container 525 into the compartments 525*a* and 525*b*, and there is provided a binding apparatus controller 501 that adjusts the temperature of the heater 526 according to the temperature detected by the thermistor N2.

To apply glue to the sheet bundle 540, the interior of the glue container 525 needs to be kept within a predetermined temperature range in which glue can liquefy. The thermistor N2 provided in the glue container 525 detects the temperature of glue, and the binding apparatus controller 501 adjusts the temperature of glue by decreasing the temperature of the heater 526 when the temperature of glue increases beyond the predetermined temperature range, and to increase the temperature of the heater 526 when the temperature of glue falls outside the predetermined temperature range.

Figure 13:
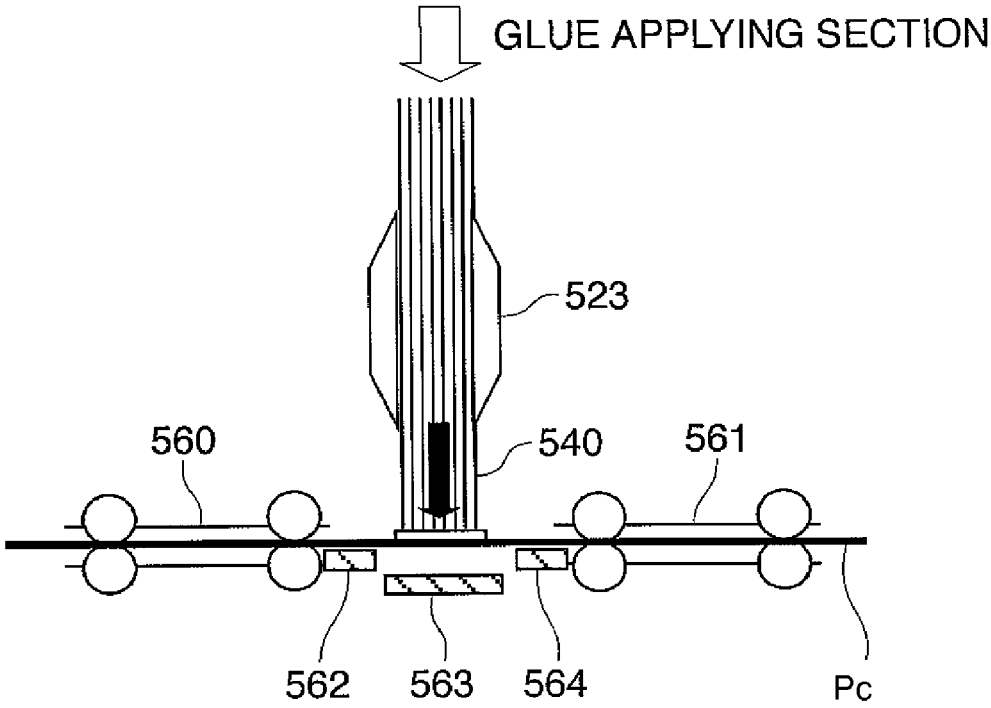
FIG. 13 is a sectional view showing a glue bonding section.

FIG. 13 is a sectional view showing the glue bonding section 582.

The glue bonding section 582 is comprised of conveying guides 560 and 561 that receive and convey a cover Pc supplied from the image forming apparatus 10 and stop the cover Pc at a predetermined position, a pressurizing member 563 that brings the cover Pc into urging contact with the glue applied surface of the sheet bundle 540, and folding members 562 and 564 for casing the sheet bundle 540 in the cover Pc.

Referring to FIGS. 13 to 20, a description will now be given of the procedure of a process carried out by the glue bonding section 582.

After the application of the glue to the sheet bundle 540 is completed, a driving means, not shown, causes the glue applying gripper 523 gripping the sheet bundle 540 to move down from the glue applying section 541. The lower side edge of the sheet bundle 540, i.e., the glue applied to surface of the sheet bundle 540, is bonded to the cover Pc placed in a horizontal position by the conveying guides 560 and 561 (FIG. 13).

Figure 14:
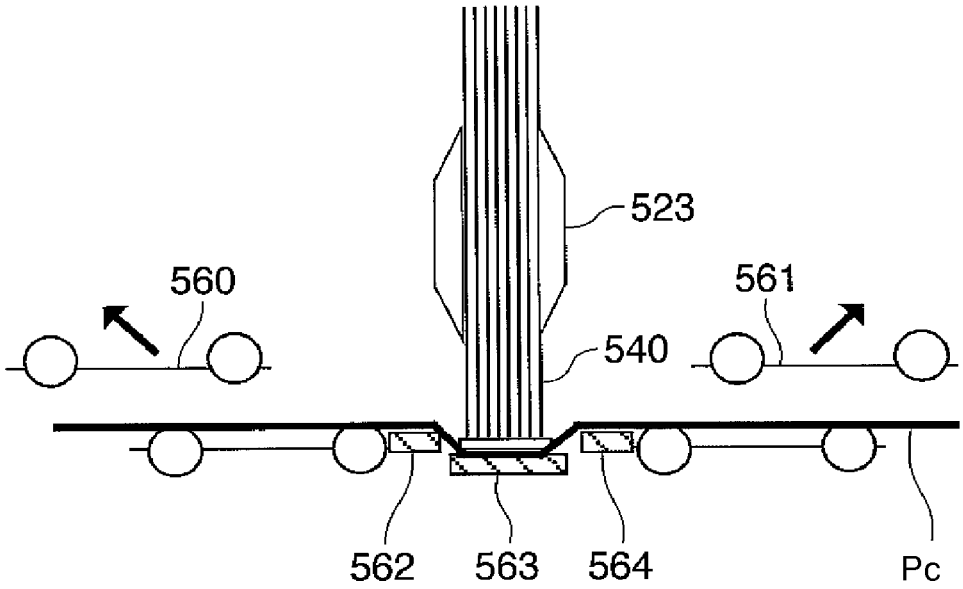
FIG. 14 is a view showing a state in which the cover is brought into urging contact with and bonded to a glue applied surface of the sheet bundle.

After that, the glue applying gripper 523 further moves down to bring the cover Pc placed above the pressurizing member 563 into urging contact with the glue applied surface of the sheet bundle 540, so that the cover Pc is bonded to the glue applied surface of the sheet bundle 540. Before the sheet bundle 540 is moved down to bring the cover Pc into urging contact with the glue applied surface of the sheet bundle 540, an upper part of the conveying guide 560 and an upper part of the conveying guide 561 are caused to retract so as to prevent their interference with the sheet bundle 540 (FIG. 14).

Figure 15:
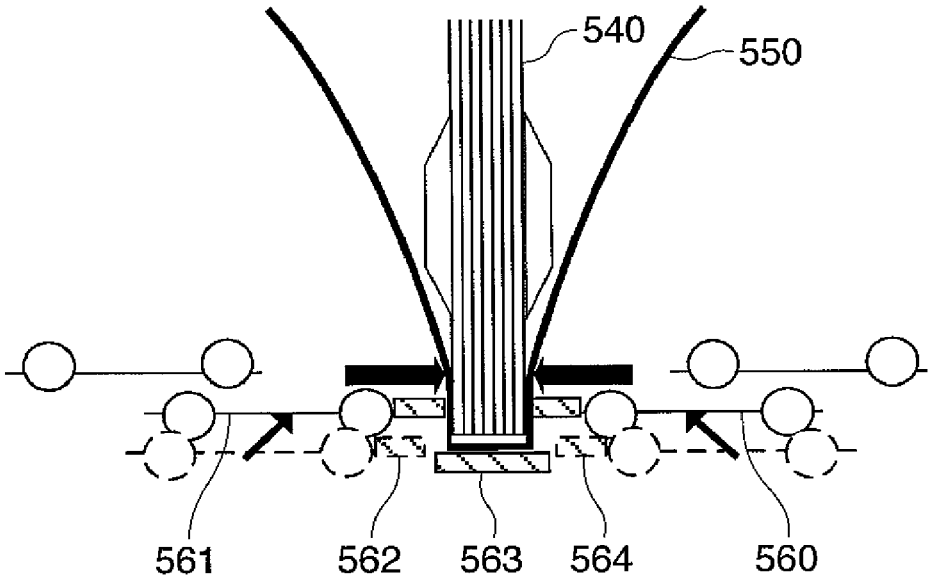
FIG. 15 is a view showing a state in which lower parts of two folding members and two conveying guides move up obliquely to a pressurizing member.

After the cover Pc is bonded to the sheet bundle 540, the folding members 562 and 564, a lower part of the conveying guide 560, and a lower part of the conveying guide 561 are caused to move up obliquely to the pressurizing member 563 (in such a direction as to approach the sheet bundle 540) by a driving means, not shown, from positions indicated by broken lines in FIG. 15 to positions indicated by solid lines in FIG. 15. The obliquely upward movement of the folding members 562 and 564 push up the cover Pc and causes the cover Pc to be curved from side edges of the glue applied surface of the sheet bundle 540, so that casing-in processing in which the sheet bundle 540 is cased in the cover Pc is performed (FIG. 15).

Figure 16:
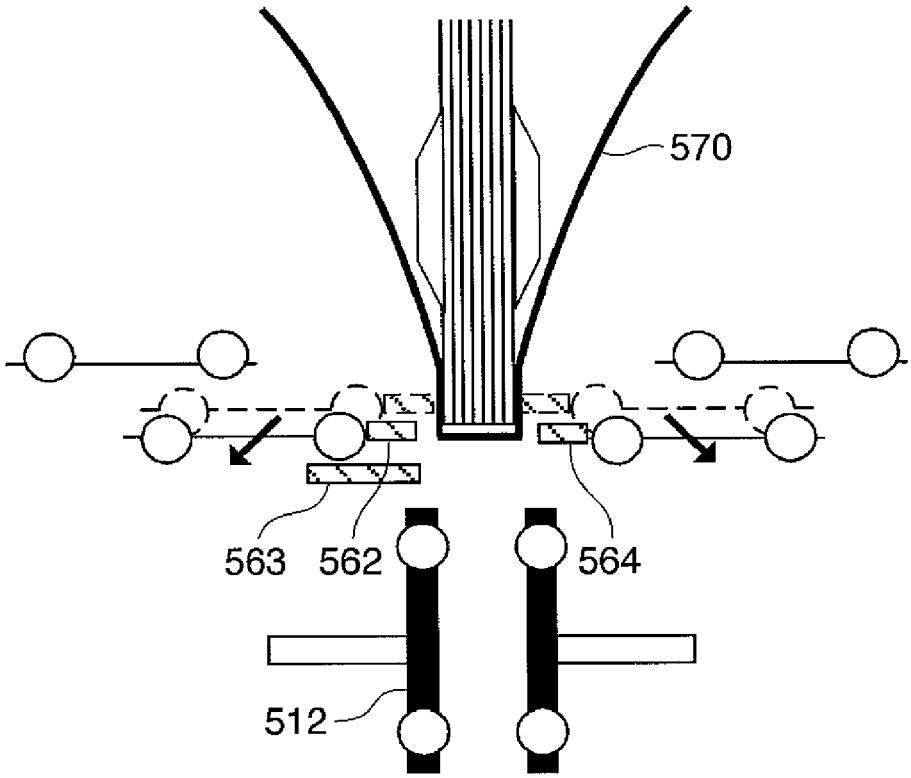
FIG. 16 is a view showing a state in which the lower parts of the two folding members and two conveying guides having moved up returns to their original positions.

After the casing-in processing of the sheet bundle 540, the folding members 562 and 564, the lower part of the conveying guide 560, and the lower part of the conveying guide 561 are caused to retract by a driving means, not shown, from positions indicated by broken lines in FIG. 16 to positions indicated by solid lines in FIG. 16. At the same time, the pressurizing member 563 is also caused to move in a horizontal direction by a driving means, not shown. The horizontal movement of the pressurizing member 563 secures a space in which the booklet 570 can be moved down by downward movement of the glue applying gripper 523 (FIG. 16).

Figure 17:
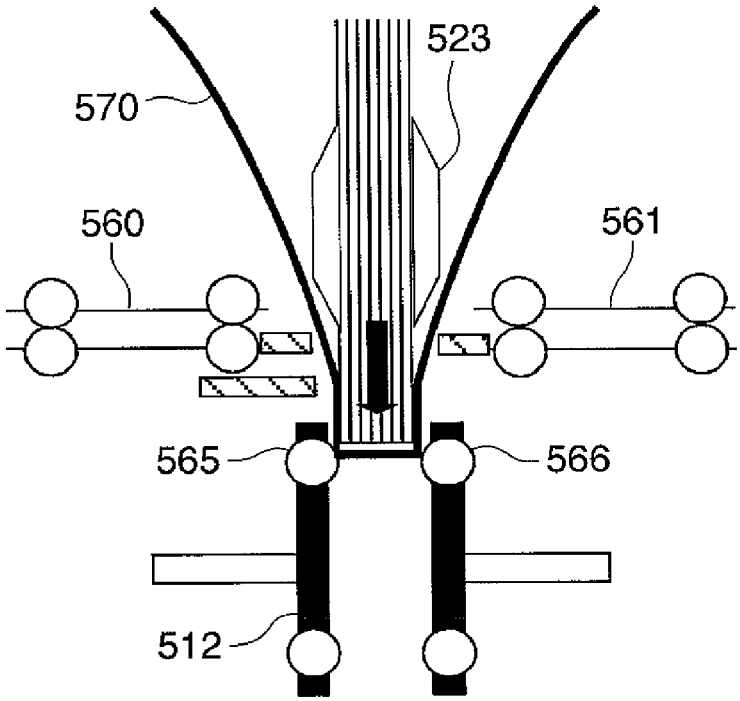
FIG. 17 is a view showing a state in which a booklet gripped by a glue applying gripper moves down.

The booklet 570, which is caused to move down to a position below the conveying guides 560 and 561 by downward movement of the glue applying gripper 523, further moves down to a position at which a lower end of the booklet 570 comes into contact with trim unit passing rollers 565 and 566 (FIG. 17).

Figure 18:
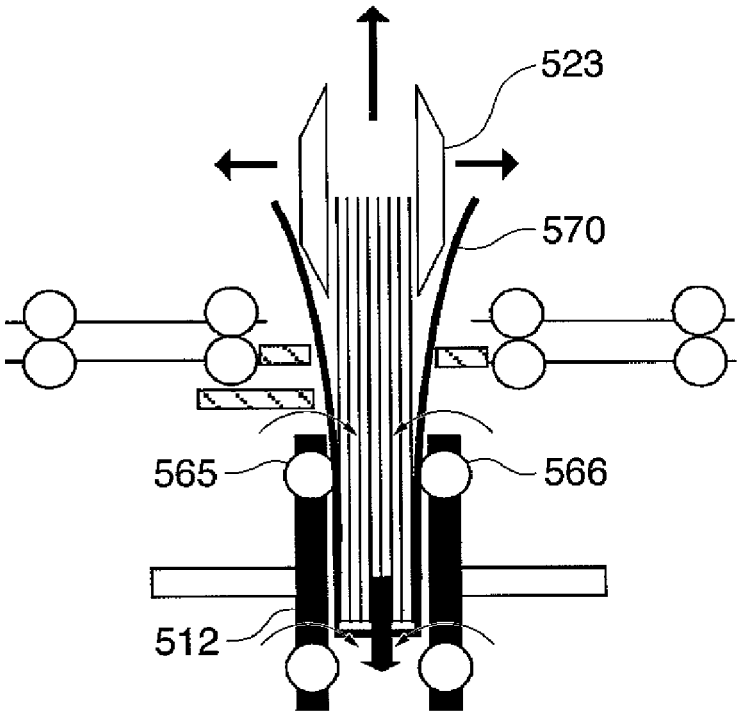
FIG. 18 is a view showing a state in which the glue applying gripper having gripped the booklet releases the booklet.

After that, the glue applying gripper 523 having gripped the booklet 570 releases the booklet 570, and at the same time, the booklet 570 is conveyed downward by the trim unit passing rollers 565 and 566 (FIG. 18).

Figure 19:
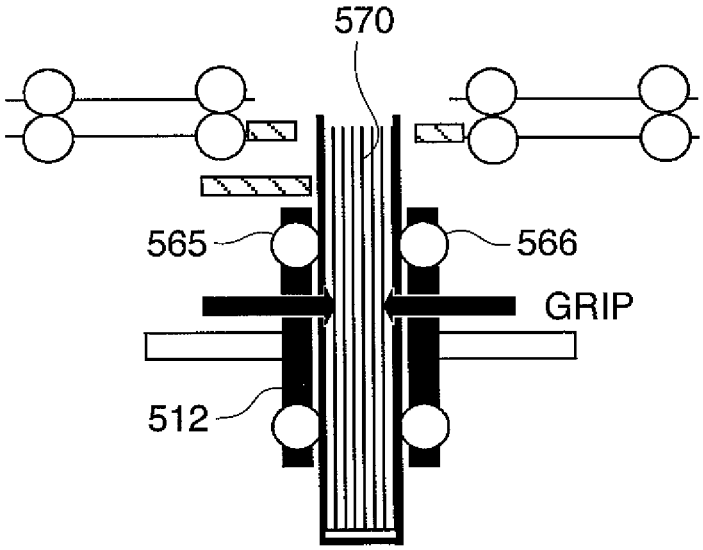
FIG. 19 is a view showing a state in which a trim gripper grips the booklet.

After the trim unit passing rollers 565 and 566 convey the booklet 570 to a predetermined position, the conveyance of the booklet 570 is stopped. The trim gripper 512 is then caused to grip the booklet 570 by a driving means, not shown (FIG. 19).

The trim gripper 512 gripping the booklet 507 then moves down, so that the booklet 570 is caused to move down to the cutting section 583. This completes the process by the bonding section 582. At this time, the pressurizing member 563 having moved in the horizontal direction moves to such a position as to come into urging contact with the bonded part of the cover 550 (FIG. 20).

Referring next to FIGS. 20 to 26, a description will be given of the procedure of a process carried out by the cutting section 583.

Figure 20:
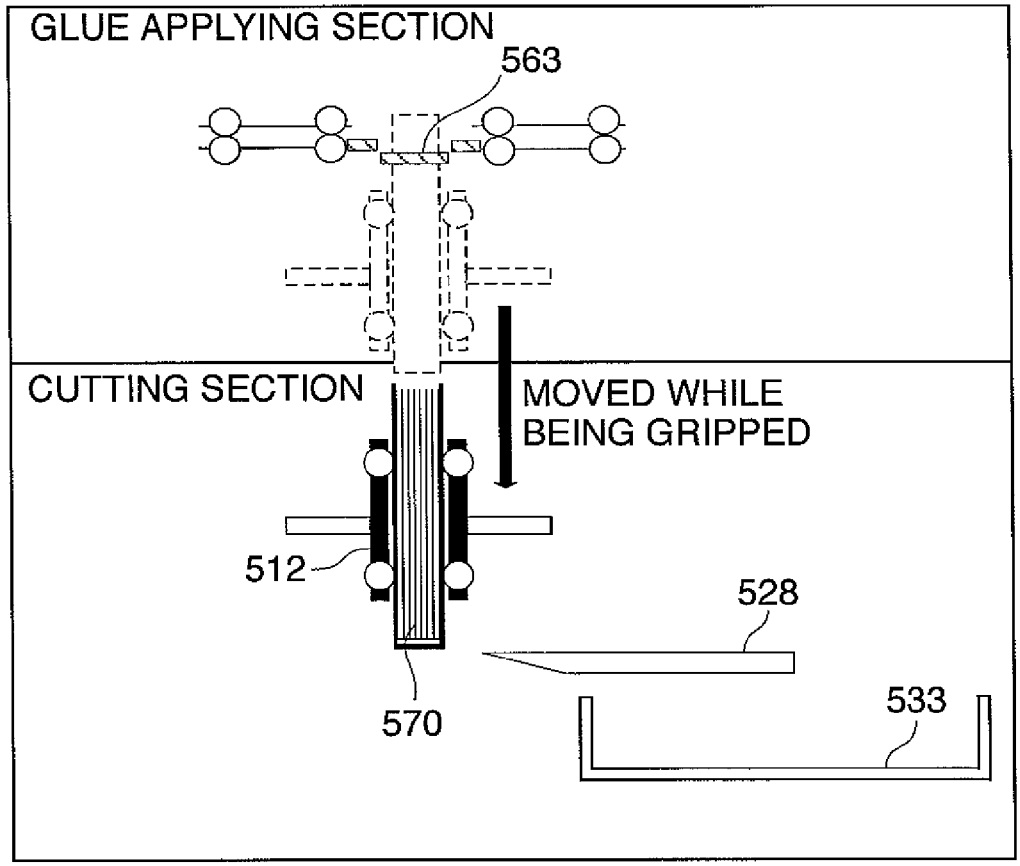
FIG. 20 is a view showing a state in which the booklet gripped by the trim gripper moves from the bonding section to a cutting section.

As shown in FIG. 20, the booklet 570 formed by bonding the bundle of inner sheets and the cover together by the bonding section 582 described above is moved to the cutting section 583, and the trim gripper 512, cutter 528, and cutting wastage receiving box 533 then move in response to movement of one another to cut three sides of the booklet 570 other than a spine thereof, i.e., a front edge, top edge, and tail edge of the booklet 570.

Figure 26:
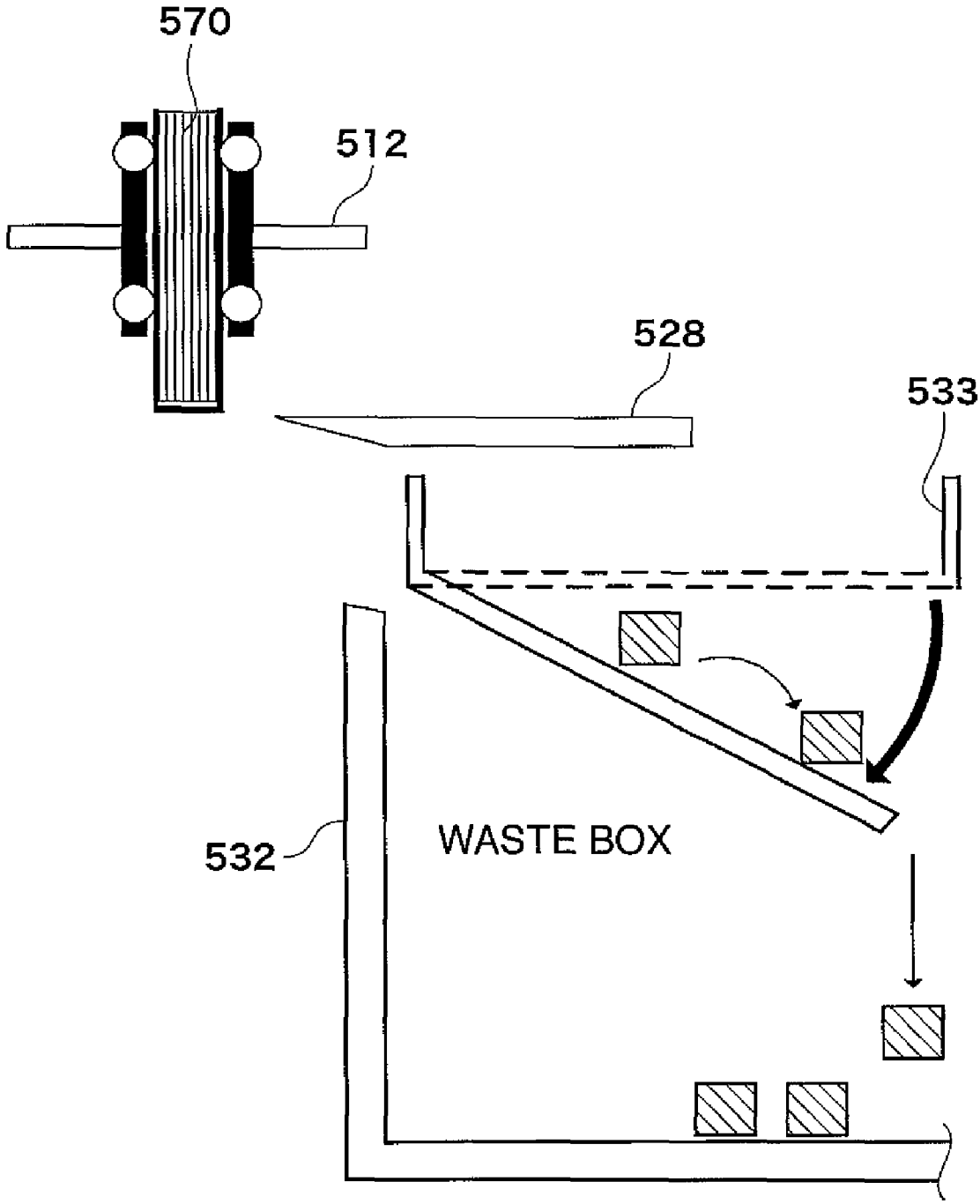
FIG. 26 is a view showing a state in which the cutting wastage in the cutting wastage receiving box is collected into a cutting wastage box.

The cutting wastage receiving box 533 moves between a retracted position at which the cutting wastage receiving box 533 lies when cutting is not performed and a wastage receiving position at which the cutting wastage receiving box 532 lies when cutting is performed. The retracted position of the cutting wastage receiving box 533 lies above the cutting wastage box 532. The bottom plate of the cutting wastage receiving box 533 is openable as shown in FIG. 26; when the cutting wastage receiving box 533 moves to the retracted position, the bottom plate of the cutting wastage receiving box 533 is opened, so that cutting wastage in the cutting wastage receiving box 533 is collected in the cutting wastage box 532.

Figure 21:
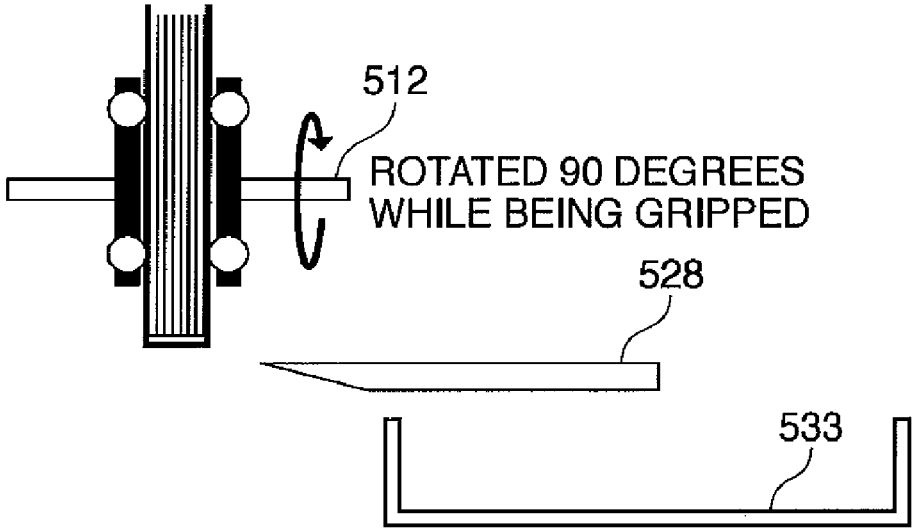
FIG. 21 is a view showing a state in which the trim gripper is rotated 90 degrees.
Figure 22:
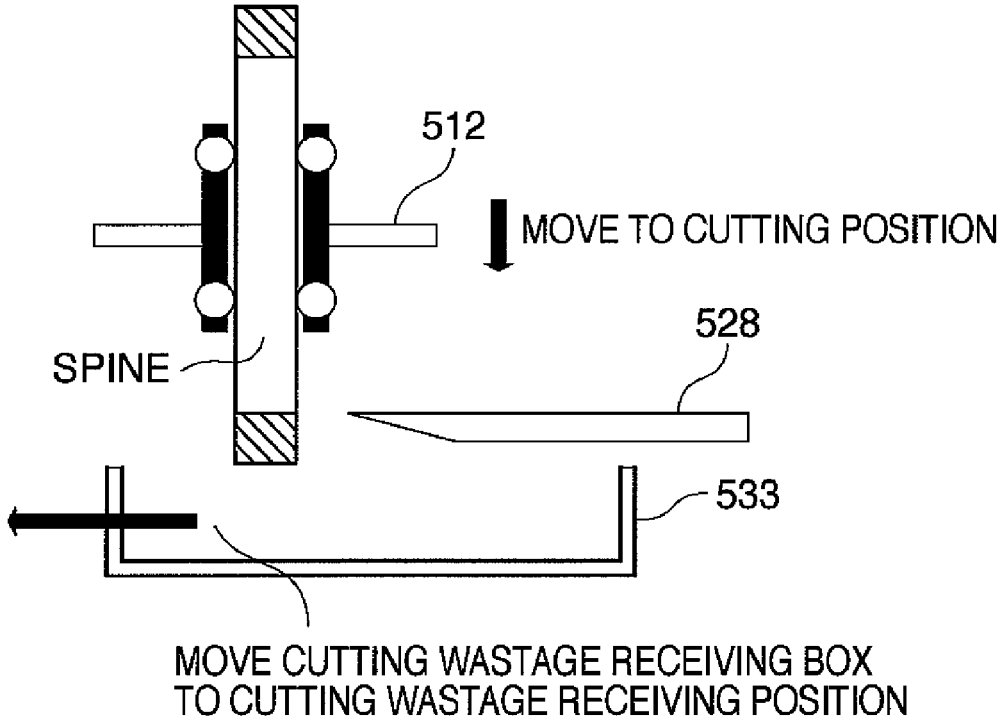
FIG. 22 is a view showing a state in which a cutting wastage receiving box moves.
Figure 23:
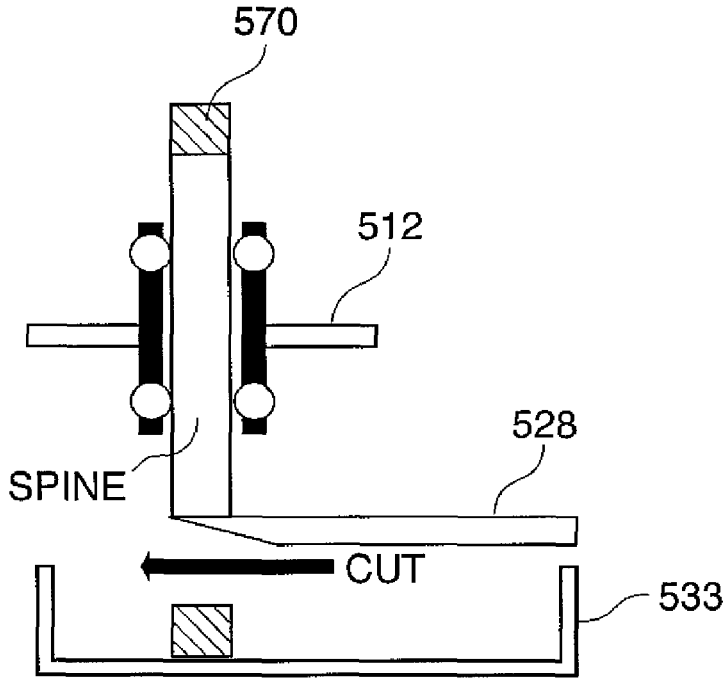
FIG. 23 is a view showing a state in which cutting wastage is collected into the cutting wastage receiving box.
Figure 24:
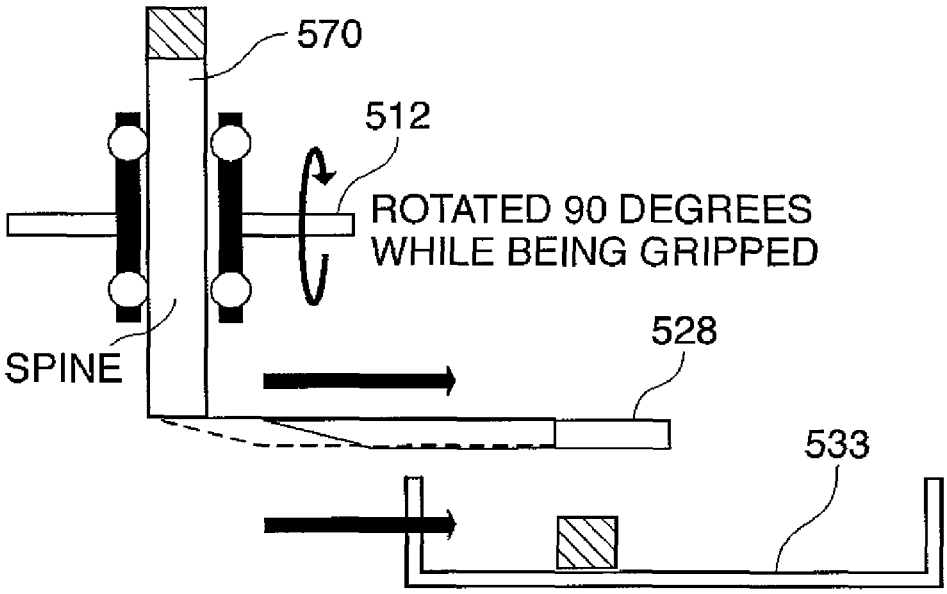
FIG. 24 is a view showing a state in which a cutter and the cutting wastage receiving box move to a retracted position.

Immediately after the bonding operation is performed, the booklet 570 is transferred with the spine thereof facing downward to the cutting section 583, and therefore, in the cutting process, first, the rotatable trim gripper 512 is rotated 90 degrees to rotate the booklet 570 90 degrees (FIG. 21). Before the cutter 528 cuts the booklet 570, the cutting wastage receiving box 533 moves to a position below the booklet 570 (FIG. 22), and the cutter 528 then projects toward the booklet 570 to cut one side of the booklet 570. At this time, cutting wastage is collected in the cutting wastage receiving box 533 which has been waiting for the cutting wastage at a position below the booklet 570 (FIG. 23). After that, the cutter 532 is driven in a reverse direction to move to a retracted position, and the cutting wastage receiving box 533 also moves to the retracted position (FIG. 24). At the same time, the trim gripper 512 is rotated 90 degrees to rotate the booklet 570 90 degrees.

The process described above with reference to FIGS. 21 to 24 is repeatedly carried out to completely cut the sides of the booklet 570 other than the spine, i.e. the front edge, top edge, and tail edge of the booklet 570.

Figure 25:
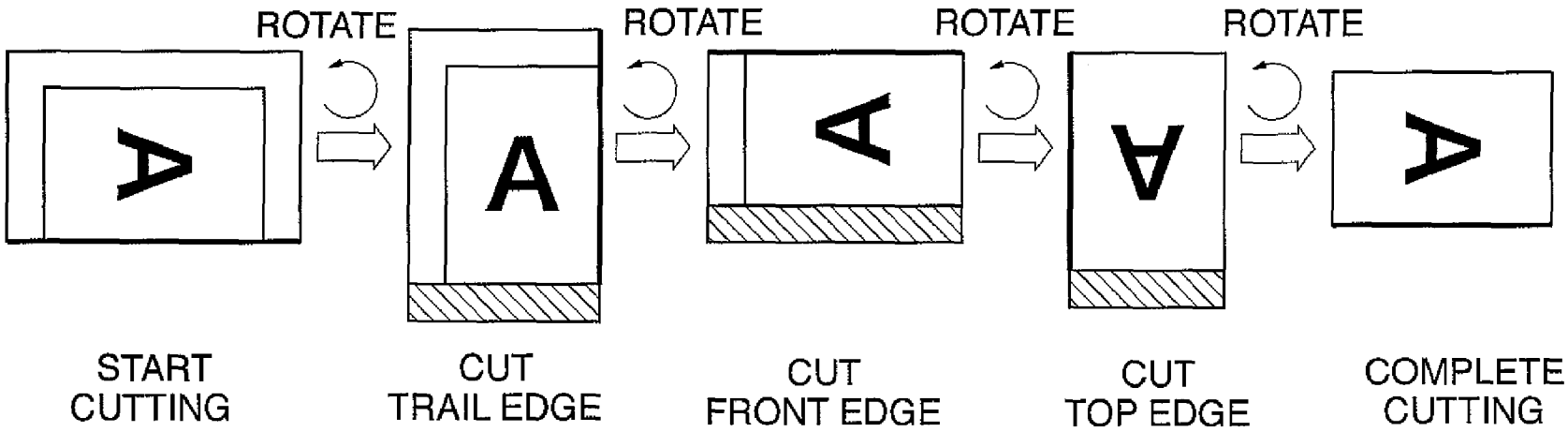
FIG. 25 is a diagram showing the general outline of a process sequence carried out by the cutting section.

The booklet 570 whose top edge has been cut is further rotated 90 degrees by the trim gripper 512 so as to be conveyed with the spine thereof facing downward to the booklet discharge section 584 (FIG. 25). This completes the process by the cutting section 583.

Figure 27:
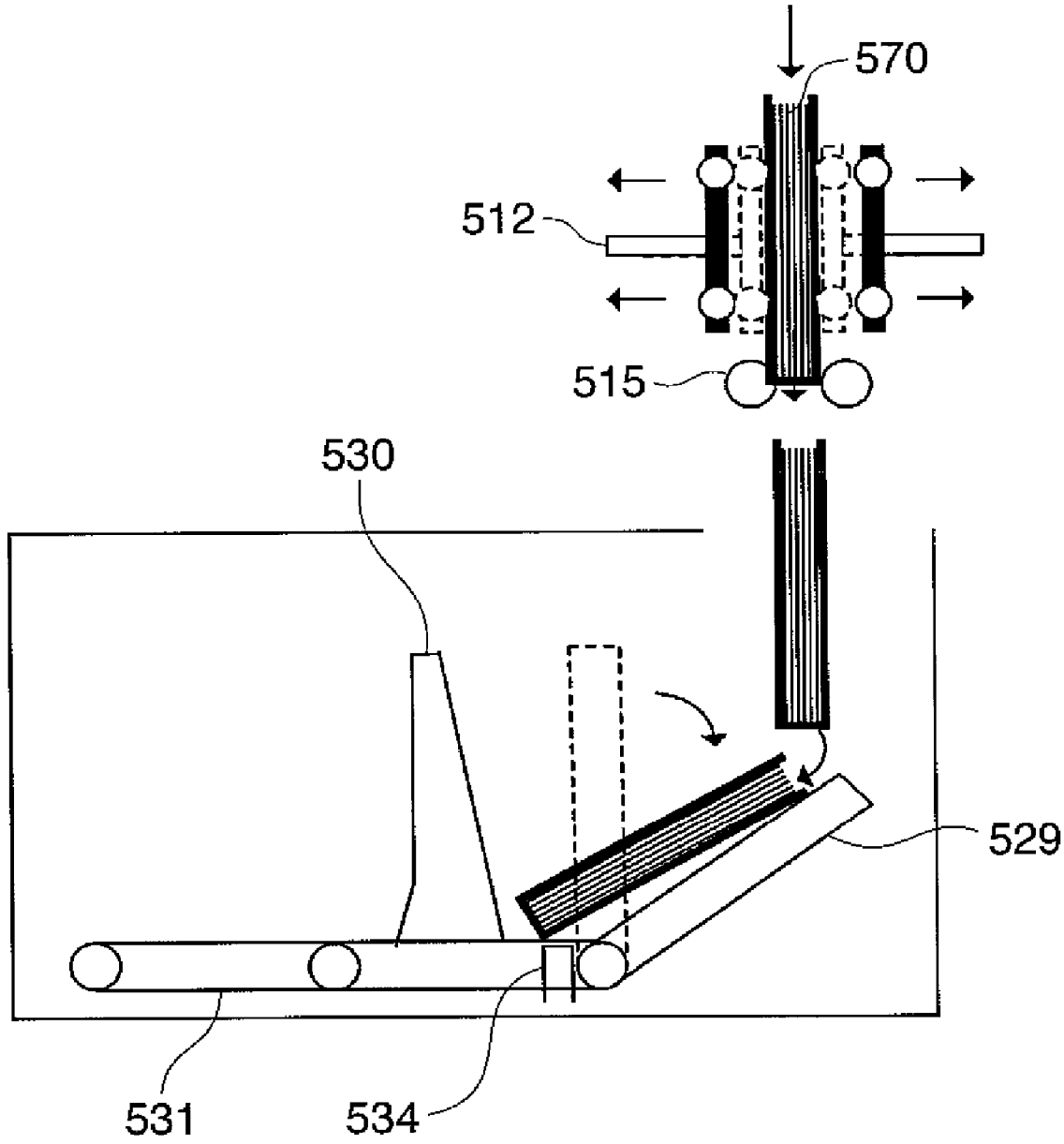
FIG. 27 is a view showing a state in which a booklet stacking plate tilts rightward to place the booklet thereon.

FIG. 27 is a sectional view showing the booklet discharge section 584.

The booklet discharge section 584 is comprised of the booklet discharge section entrance rollers 515 for taking in the booklet 570 conveyed from the cutting section 583 by the trim gripper 512, a booklet stacking plate 529 on which the conveyed booklet 570 is temporarily placed, a booklet supporting plate 530 that supports the booklet 570 by propping it against the plate 530, a booklet discharge stacking stabilizing plate 534, and a discharge conveying belt 531 that moves the booklet supporting plate 530 in a horizontal direction.

Referring to FIGS. 27 to 30, a description will be given of the procedure of a process carried out by the booklet discharge section 584.

The booklet 570 for which cutting has been completed is conveyed to the booklet discharge section entrance rollers 515 located just below the cutting section 583 by downward movement of the trim gripper 512. The booklet 570 is then conveyed by the booklet discharging section entrance rollers 515, and the trim gripper 512 releases the booklet 570 and moves to a predetermined position in the glue bonding section 582. At this time, in the booklet discharge section 584, the booklet stacking plate 529 is tilted rightward, and the booklet 570 is placed on the booklet stacking plate 529 by the booklet discharge section entrance rollers 515 (FIG. 27).

Figure 28:
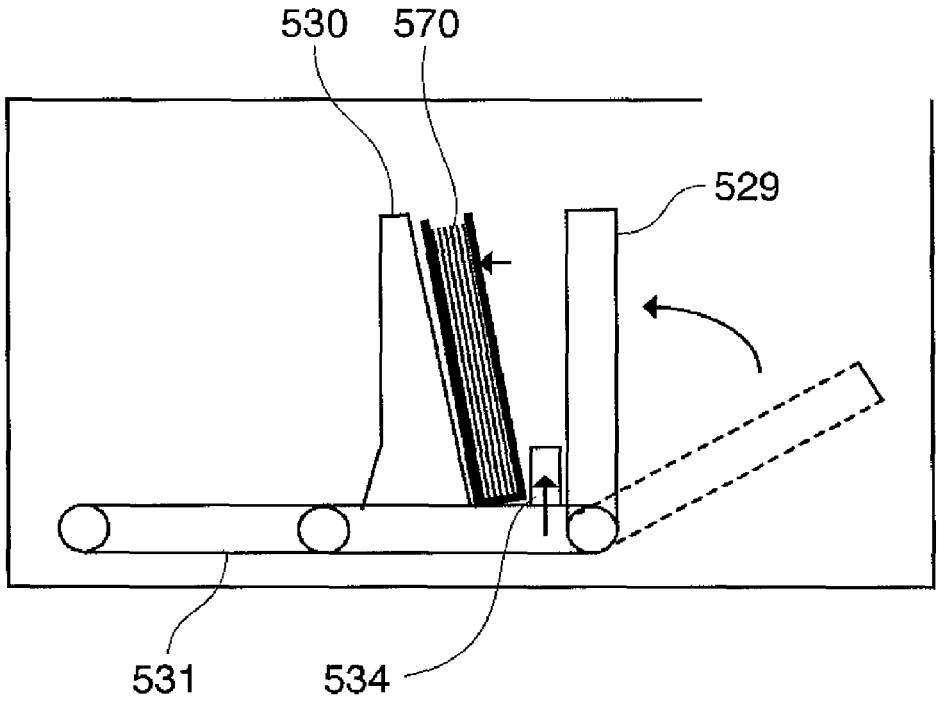
FIG. 28 is a view showing a state in which the booklet stacking plate stands in a vertical position and a booklet discharge stabilizing plate moves up.
Figure 29:
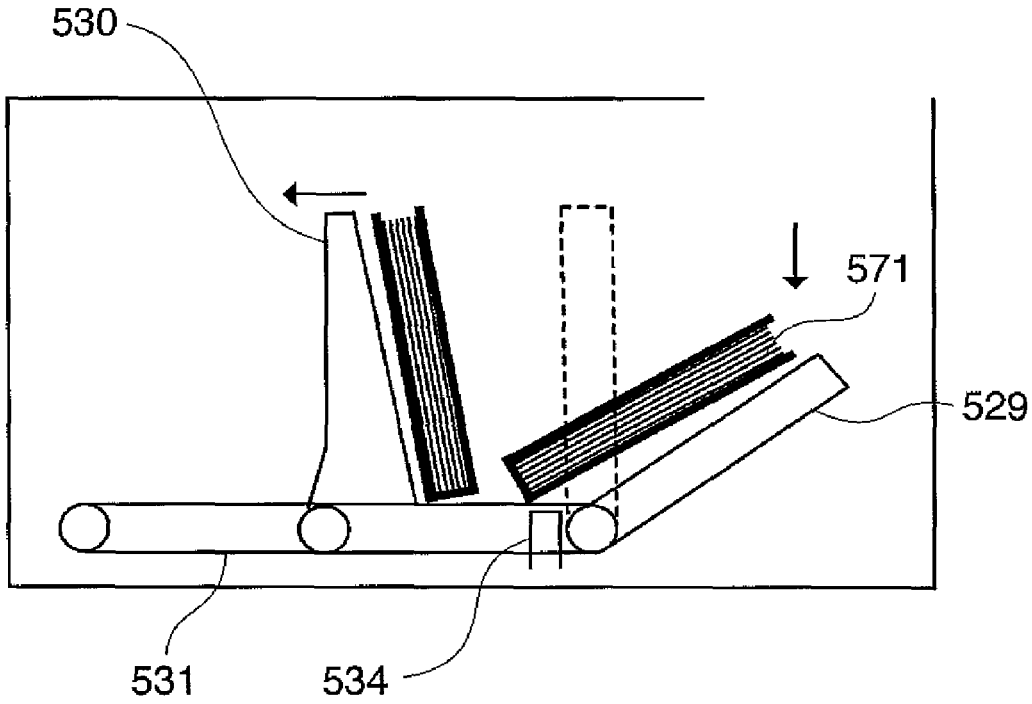
FIG. 29 is a view showing a state in which a booklet supporting plate is caused to move leftward by a discharge conveying belt.
Figure 30:
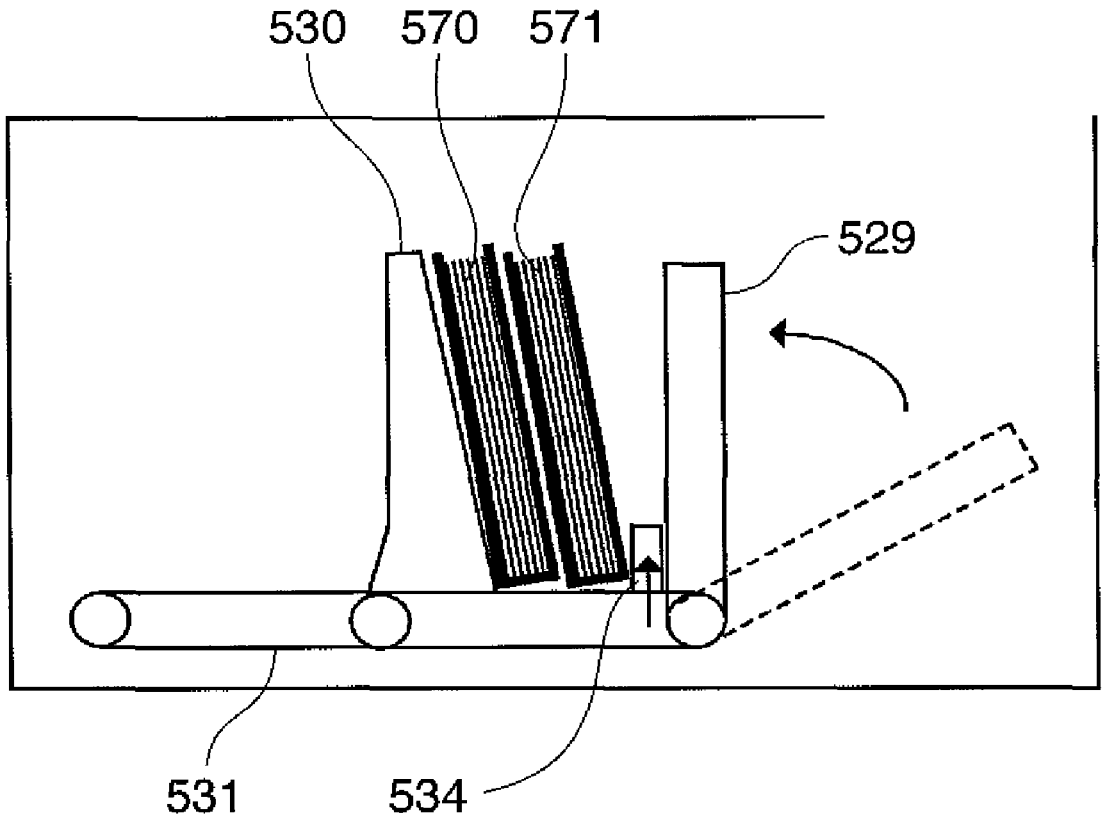
FIG. 30 is a view showing a state in which a plurality of booklets are stacked in a standing condition on the booklet supporting plate.

After that, the tilted booklet stacking plate 529 stands up in an upright position, and the booklet 570 is supported in the state of being propped against the booklet supporting plate 530. At this time, the booklet discharge stabilizing plate 534 lying below the discharge conveying belt 531 moves upward, and the booklet supporting plate 530 and the booklet discharge stabilizing plate 534 support the booklet 570 (FIG. 28). The booklet supporting plate 530 is then caused to move leftward by the discharge conveying belt 531 to secure a space for discharging the next booklet 571 when it is conveyed to the booklet discharge section 584 (FIG. 29). After that, by carrying out the same process as the process described above with reference to FIGS. 27 and 28, the booklet 571 is placed in a standing position next to the booklet 570 (FIG. 30).

When a predetermined number of volumes of booklets are placed on the discharge conveying belt 531 by repeatedly carrying out the above described process, the discharge conveying belt 531 is rotated to discharge the predetermined number of volumes of booklets from the booklet discharge section 584.

Figure 31:
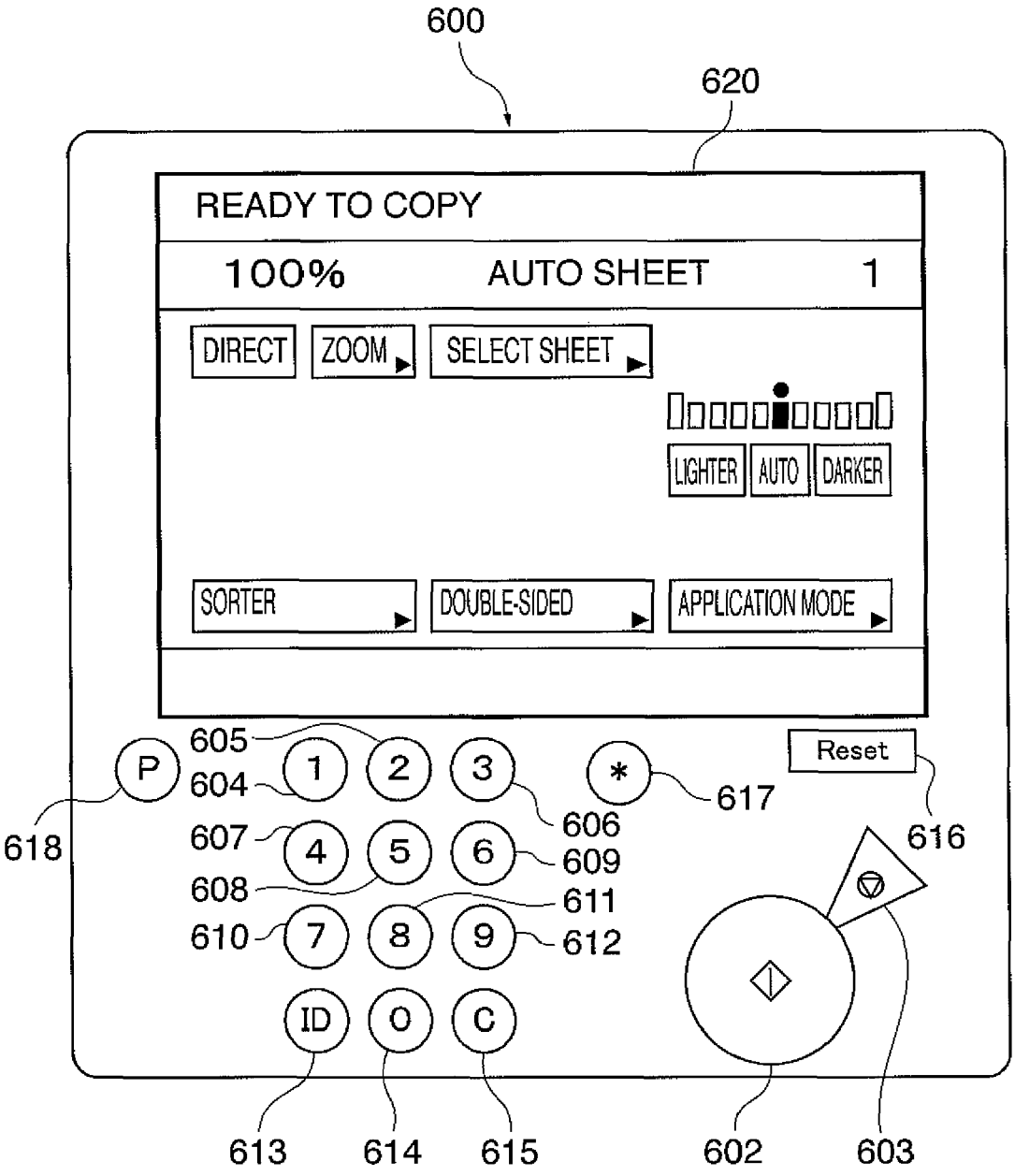
FIG. 31 is a view showing the layout of an operation display unit in an image forming apparatus appearing in FIG. 1.
Figure 32:
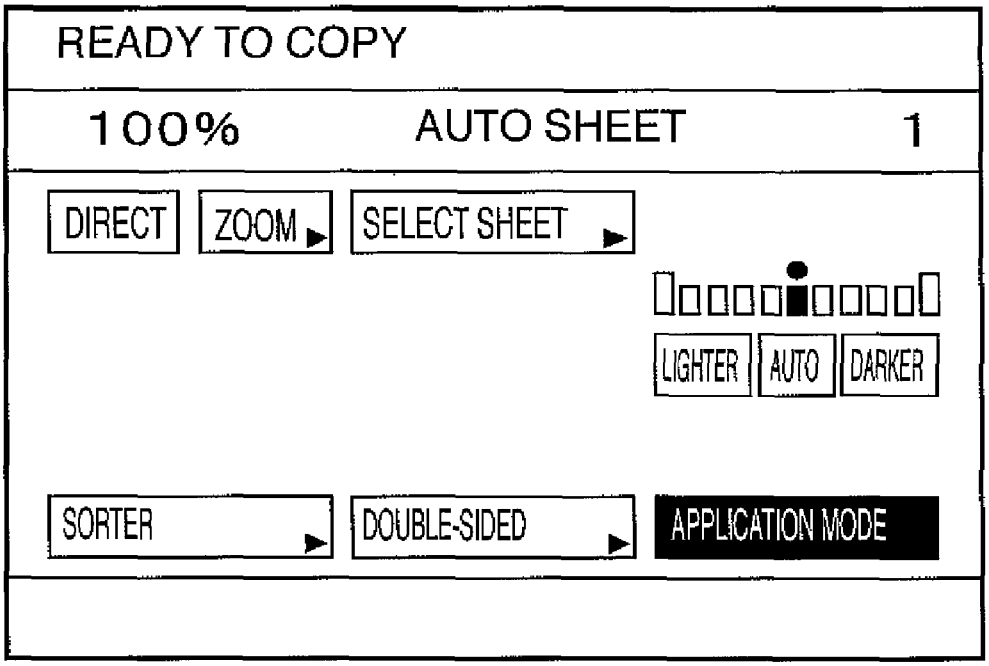
FIG. 32 is a view showing an example of an initial screen view on a liquid crystal display unit.

FIG. 31 is a view showing the layout of the operation display device 600 in the image forming apparatus 10 appearing in FIG. 1.

A start key 602 for starting an image forming operation, a stop key 603 for stopping an image forming operation, a ten-key numeric pad consisting of keys 604 to 612 and 614, an ID key 613, a clear key 615, a reset key 616, a user setting key 617, a standby return key 618, and so forth are arranged on the operation display device 600. Also, a liquid crystal display unit 620 comprised of a touch panel is disposed on the operation display device 600, so that soft keys can be created on the liquid crystal display unit 620.

The image forming apparatus 10 is provided with postprocessing modes such as a non-sort mode, a sort mode, and the bookbinding mode executed by the postprocessing apparatus 400 and the gluing bookbinding apparatus 500. These processing modes are set through input operation via the operation display device 600.

A description will now be given of how the bookbinding mode is set.

Figure 42:
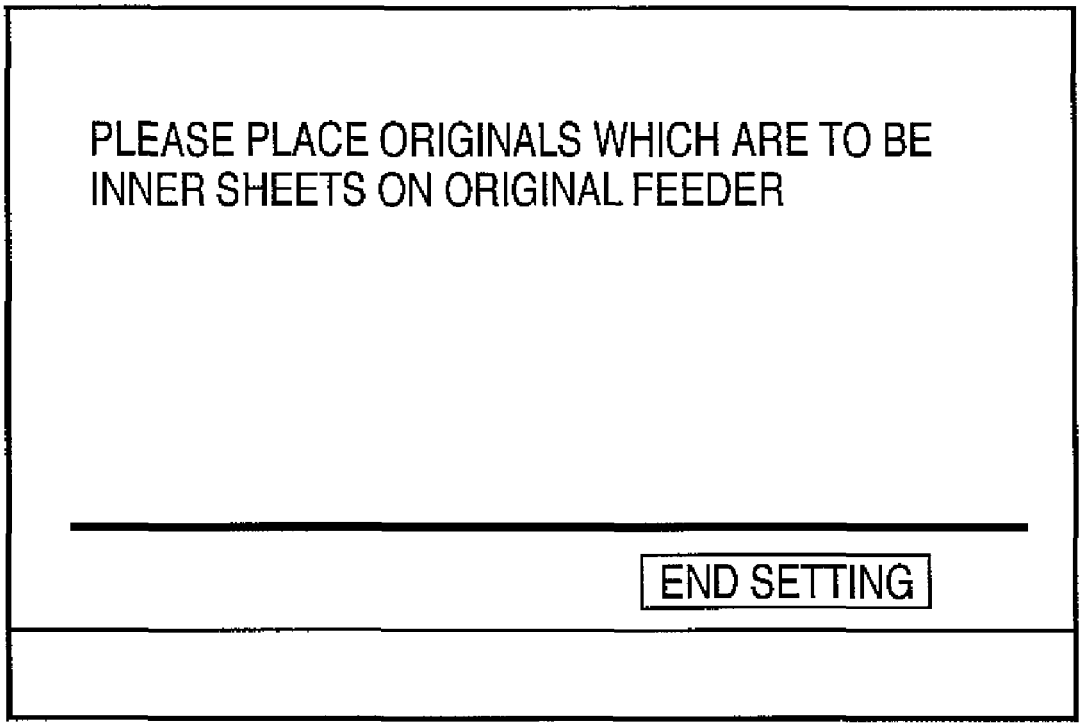
FIG. 42 is a view showing an example of a screen view for prompting the user to place originals which are to be inner sheets on the original feeder.
Figure 43:
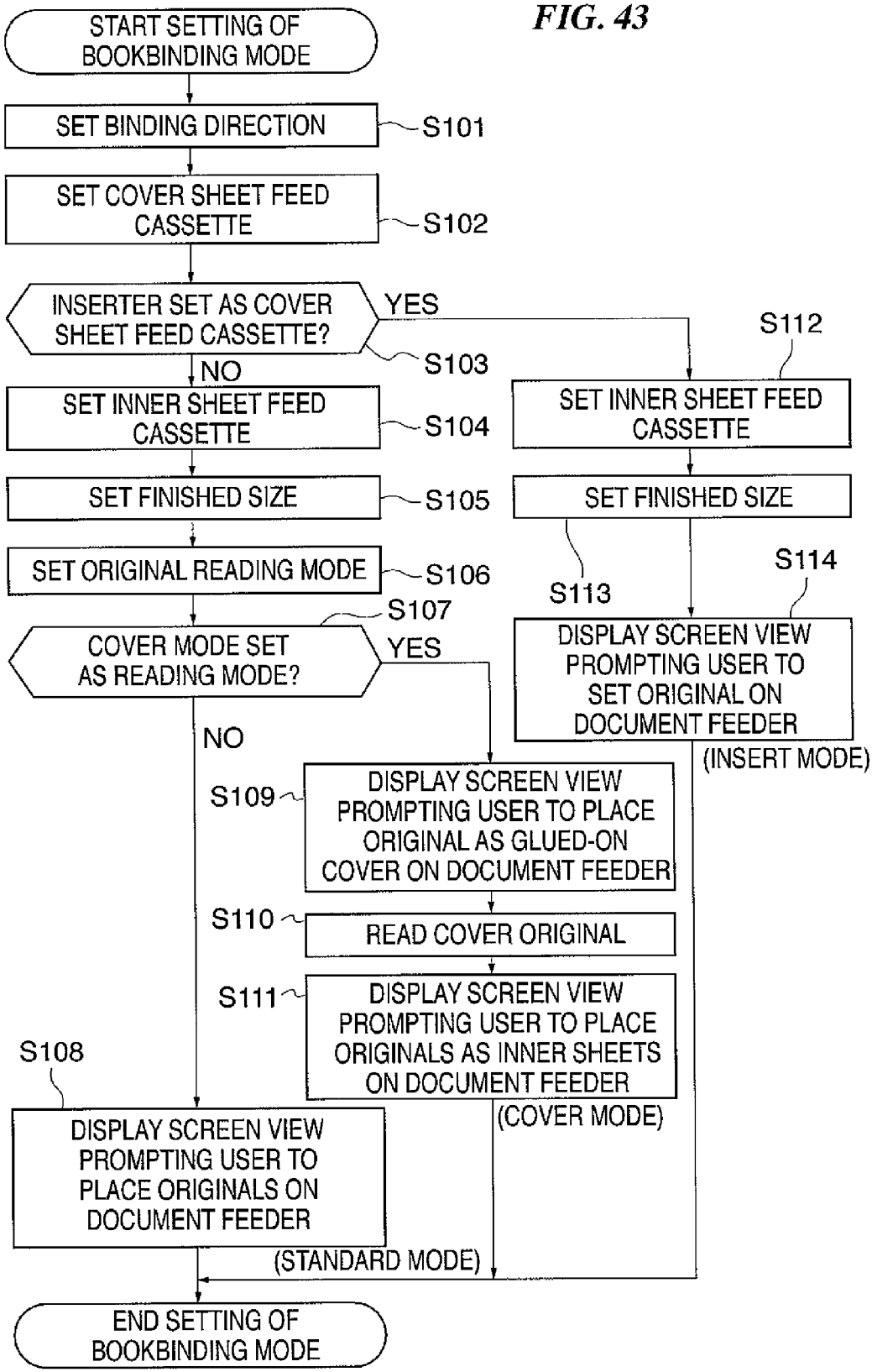
FIG. 43 is a flow chart showing how a bookbinding mode is set.

FIGS. 32 to 42 are views showing examples of screen views displayed on the liquid crystal display unit 620 in respective steps for setting the bookbinding mode. FIG. 43 is a flow chart showing how the bookbinding mode is set.

Figure 33:
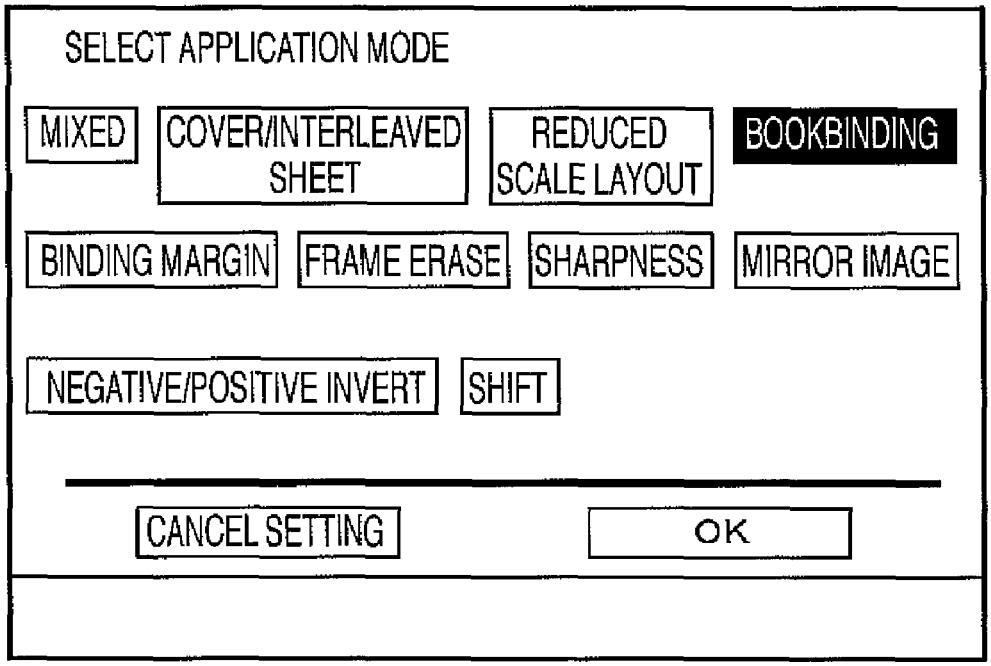
FIG. 33 is a view showing an example of a screen view for selecting an application mode.

The bookbinding mode is set on the liquid crystal display unit 620. When a soft key "Application mode" is selected on an initial screen in FIG. 32, a selection screen for the application mode appears as shown in FIG. 33. When a soft key "Bookbinding" is selected from a menu for the application mode, setting of the bookbinding mode is started.

Figure 34:
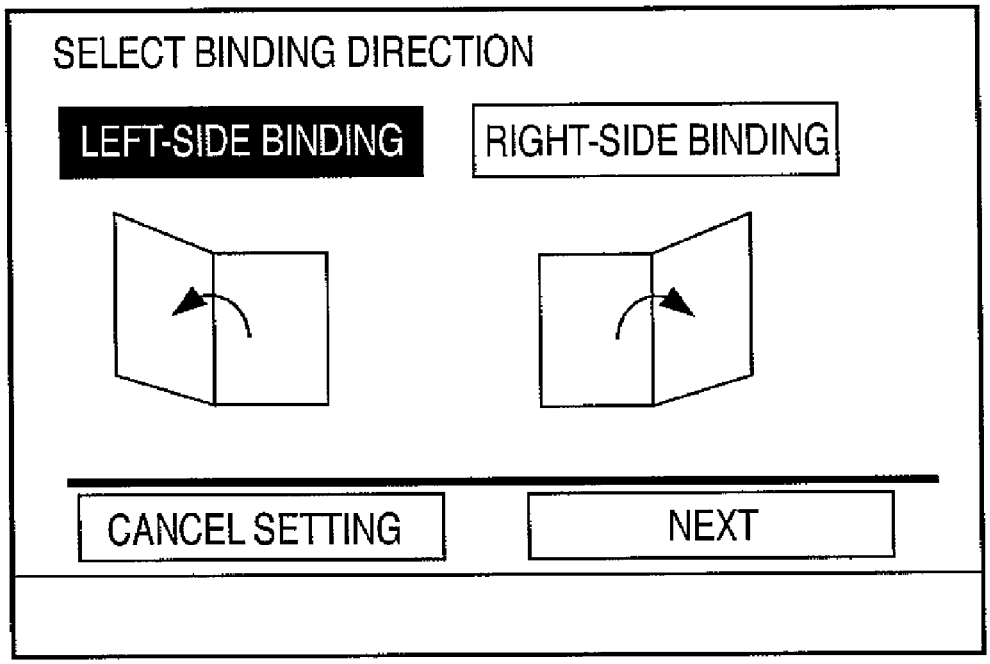
FIG. 34 is a view showing an example of a screen view for selecting a binding direction.

First, as shown in FIG. 34, a selection screen for selecting either of "Right-side binding" or "Left-side binding" as a binding direction of a binding result is displayed (step S101). The "Right-side binding" is such that the number of pages increases each time pages are turned over from a right-side page to a left-side page, and the "Left-side binding" is such that the number of pages increases each time pages are turned over from a left-side page to a right-side page.

Figure 35:
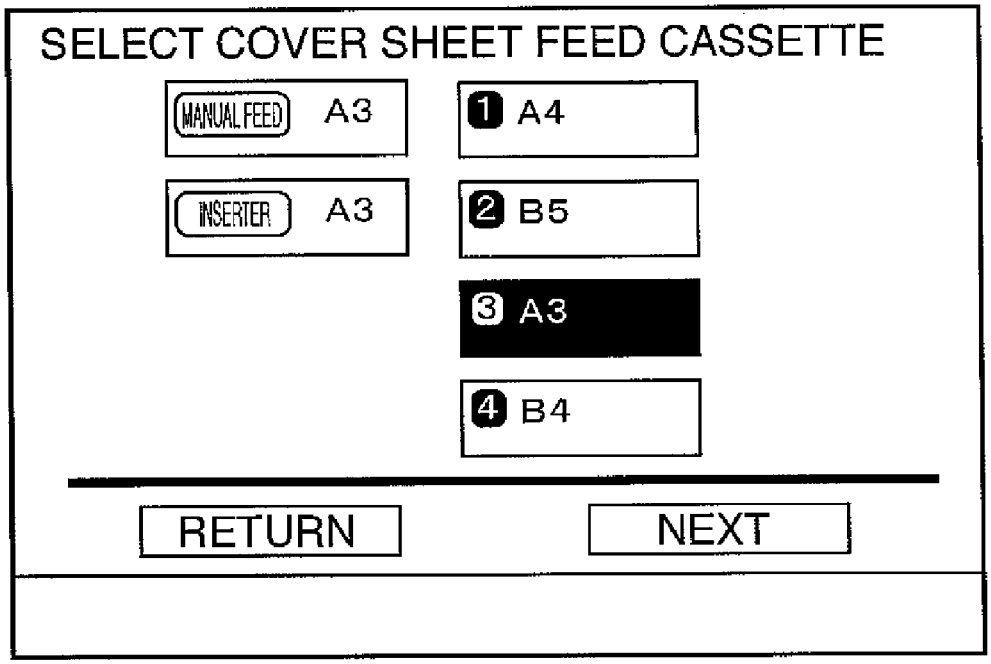
FIG. 35 is a view showing an example of a screen view for selecting a sheet feed cassette for glued-on cover feeding.

When the binding direction of the binding result is selected in the step S101 and a soft key "Next" appearing in FIG. 34 is depressed, a selection screen for selecting a sheet feed cassette from which a glued-on cover is to be fed is displayed as shown in FIG. 35 (step S102). Here, the sheet feed cassette from which the glued-on cover is to be fed is selected from sheet feed cassettes, the inserter 300, and so forth.

Figure 36:
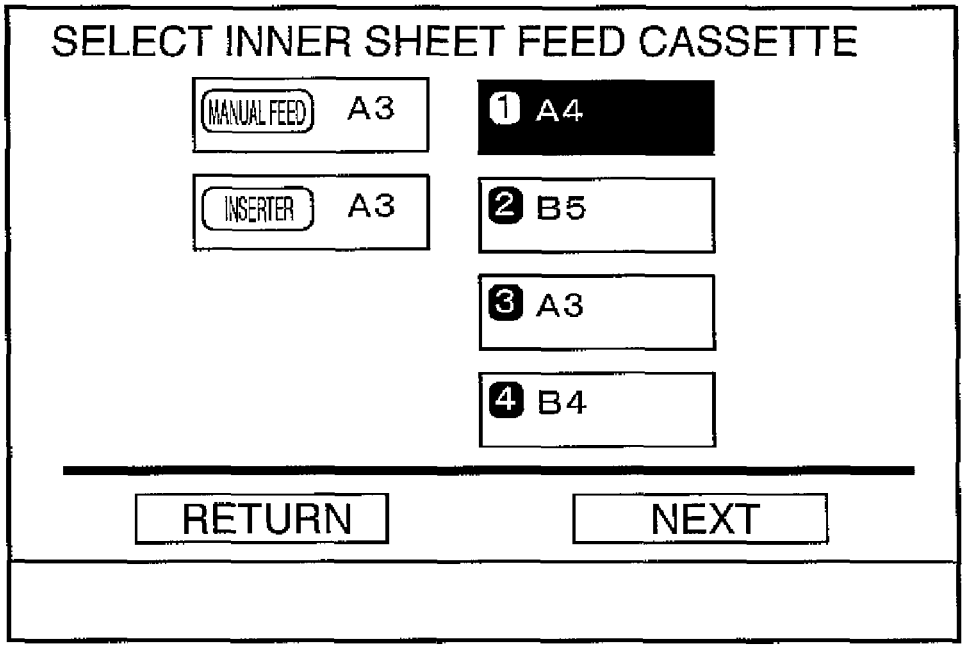
FIG. 36 is a view showing an example of a screen view for selecting a sheet feed cassette for inner sheet feeding.

It is determined whether or not the inserter 300 has been set as the sheet feed cassette from which the glued-on cover is to be fed (step S103). If the inserter 300 has not been set as the sheet feed cassette from which the glued-on cover is to be fed, i.e. if a sheet feed cassette other than the inserter 300 is selected in the step S102 and a soft key "Next" is depressed, a selection screen for selecting an inner-sheet sheet feed cassette in FIG. 36 is displayed (step S104). On the selection screen in FIG. 36, a sheet feed cassette from which a sheet bundle to be cased in the glued-on cover is to be fed is selected, and a soft key "Next" is selected.

Figure 37:
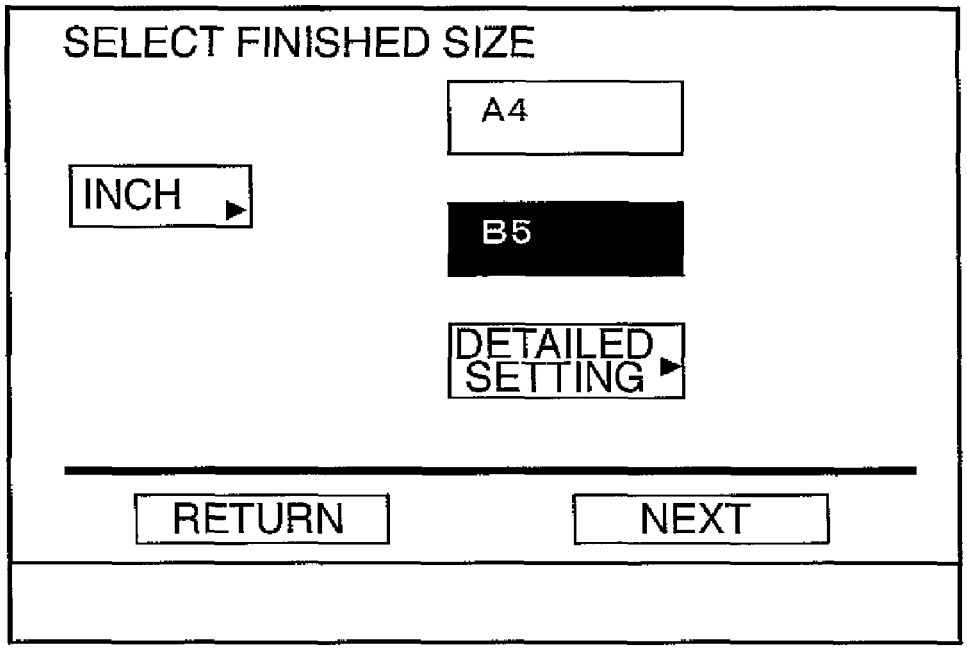
FIG. 37 is a view showing an example of a screen view for selecting a finished size.
Figure 38:
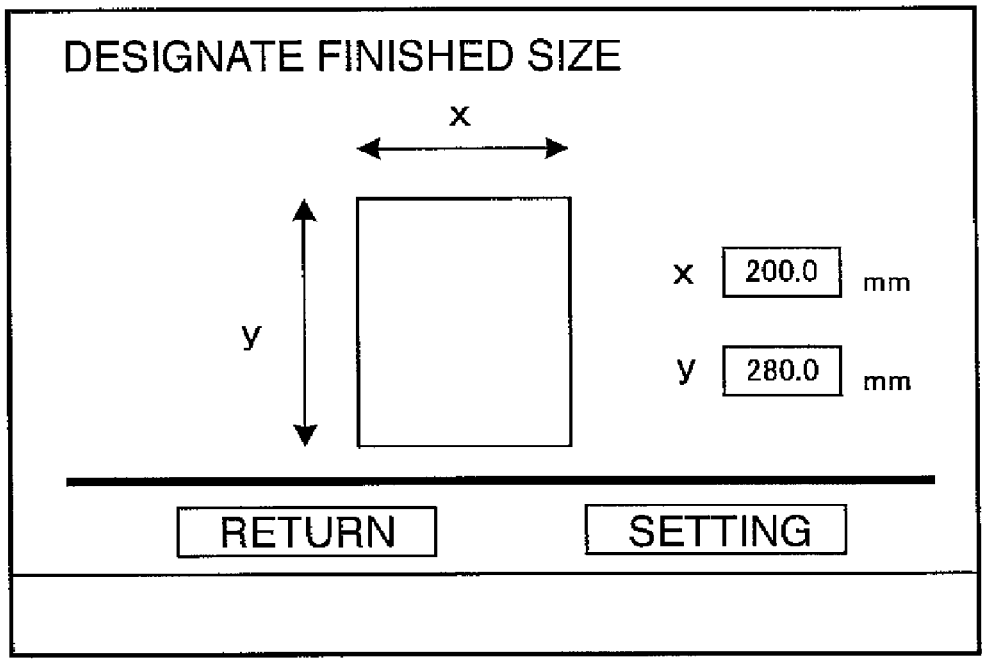
FIG. 38 is a view showing an example of a screen view for designating an actual finished size.

Next, as shown in FIGS. 37 and 38, a finished size selection screen is displayed (step S105). Specifically, on a selection screen in FIG. 37, the post-cutting size is selected from prescribed sizes, or a soft key "Detailed setting" is depressed, and a setting screen in FIG. 38 then appears so as to set an arbitrary size.

Figure 39:
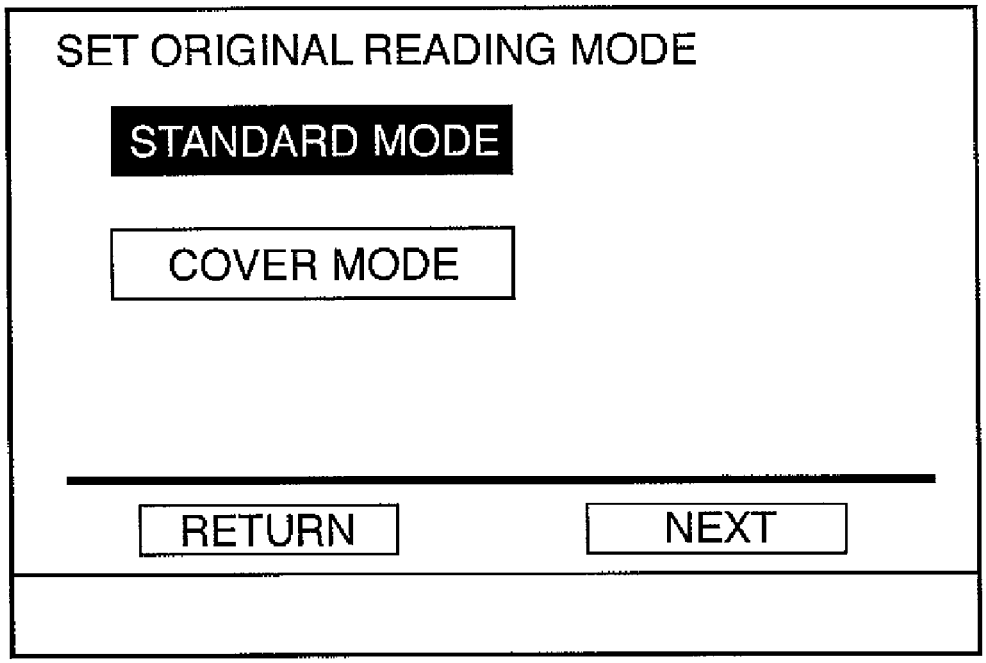
FIG. 39 is a view showing an example of a screen view for setting an original reading mode.

Next, as shown in FIG. 39, an original reading mode setting screen is displayed (step S106). Specifically, if an original for a glued-on cover and originals for inner sheets are separated, a "Cover mode" is selected on the setting screen in FIG. 39, and if cover/back cover and originals for inner sheets are combined in the form of a bundle, a "Standard mode" is selected on the setting screen in FIG. 39.

It is then determined whether or not the cover mode has been selected as an original reading mode (step S107).

If it is determined in the step S107 that the cover mode has not been selected as the original reading mode, i.e. if the "Standard mode" has been selected, a screen view as shown in FIG. 40 that prompts the user to place originals on the original feeder 100 is displayed on the liquid crystal display unit 620 (step S108), completing the setting of the bookbinding mode. In the following description, a mode in which the "Standard mode" is selected as the original reading mode to carry out bookbinding will be referred to as the "Standard mode."

If it is determined in the step S107 that the cover mode has been selected as the original reading mode, a screen view as shown in FIG. 41 that prompts the user to place an original which is to be the glued-on cover and depress the start key 602 is displayed on the liquid crystal display unit 620 so as to read the original which is to be the glued-on cover (step S109). When the start key 602 of the operation display device 600 in FIG. 31 is depressed, the reading of the cover original is started (step S110). When the reading of the cover original is completed, a screen view as shown in FIG. 42 that prompts the user to place originals which are to be inner sheets on the original feeder 100 is displayed on the liquid crystal display unit 620 (step S111), completing the setting of the bookbinding mode. In the following description, a mode in which the "Cover mode" is selected as the original reading mode to carry out bookbinding will be referred to as the "Cover mode."

If it is determined in the step S103 that the inserter 300 has been set as the sheet feed cassette from which the glued-on cover is to be fed, an inner-sheet sheet feed cassette selection screen as shown in FIG. 36 is displayed (step S112). On the selection screen in FIG. 36, the sheet feed cassette from which a sheet bundle to be cased in the glued-on cover is to be fed is selected, and the soft key "Next" is depressed.

Next, as shown in FIGS. 37 and 38, a finished size selection screen is displayed (step S113). Specifically, on a selection screen in FIG. 37, the post-cutting size is selected from prescribed sizes, or a soft key "Detailed setting" is depressed, and a setting screen in FIG. 38 then appears so as to set an arbitrary size.

Finally, a screen view as shown in FIG. 40 that prompts the user to place originals on the original feeder 100 is displayed on the liquid crystal display unit 620 (step S114), completing the setting of the bookbinding mode. In the following description, a mode in which bookbinding is carried out by feeding a cover from the inserter 300 will be referred to as an "Inserter mode."

Figure 44:
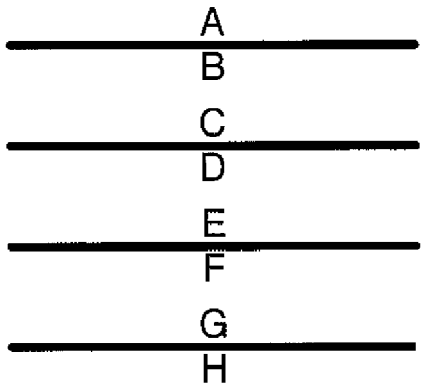
FIG. 44 is a diagram showing the orientations and order of originals in the case where the originals are placed in a standard mode.

Referring next to FIGS. 44 to 46, a description will be given of orientations and orders of originals when they are placed on the original feeder 100 or the inserter 300.

In the case where the standard mode is set as the bookbinding mode, originals are placed on the original feeder 100 in such a manner that a first page A lies at the uppermost position as shown in FIG. 44.

Figure 45A:
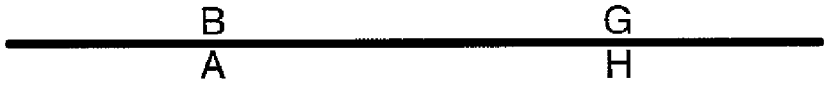
FIG. 45A is a diagram showing the orientation of an original in the case where the original which is to be a glued-on cover is placed in a cover mode.
Figure 45B:
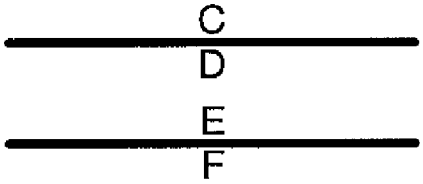
FIG. 45B is a diagram showing the orientations and order of originals in the case where the originals which are to be inner sheets are placed in the cover mode.

In the case where the cover mode is set as the bookbinding mode, when the user is prompted to place an original which is to be a glued-on cover, an original which is to be a glued-on cover is placed in an orientation shown in FIG. 45A on the original feeder 100 in such a manner that a page A which is to be a front cover of a binding result faces downward and a page G which is to be a back cover faces upward, and when the user is prompted to place originals which are to be inner sheets on the original feeder 100, originals are placed on the original feeder 100 in an orientation and order shown in FIG. 45B in such a manner that a first page C of an original which is to be an inner sheet lies at the uppermost position.

Figure 46A:
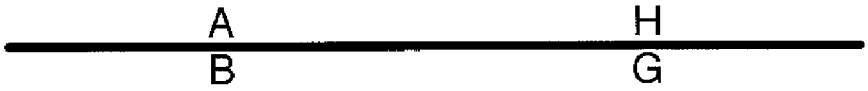
FIG. 46A is a diagram showing the orientation of an original in the case where the original which is to be a cover is placed when the binding direction of a binding result is "right-side binding" in an inserter mode.
Figure 46B:
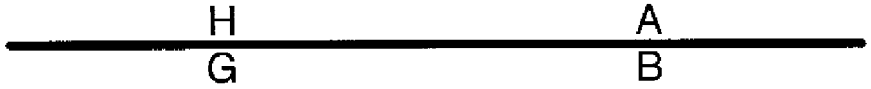
FIG. 46B is a diagram showing the orientation of an original in the case where the original which is to be a cover is placed when the binding direction of a binding result is "left-side binding" in the inserter mode.
Figure 46C:
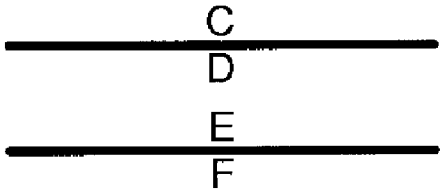
FIG. 46C is a diagram showing the orientation and order of originals in the case where the originals which are to inner sheets are placed in the inserter mode.

In the case where the inserter mode is set as the bookbinding mode, an original is placed on the tray 310 of the inserter 300 in such a manner that a page A which is to be a front cover of a binding result faces upward as shown in FIG. 46A or 46B. In the case where the "Right-side binding" is set as the binding direction of a binding result, a page A is positioned to be on the right side of a page H which is to be a back cover of the binding result as shown in FIG. 46A, and in the case where the "Left-side binding" is set as the binding direction of a binding result, a page A is positioned to be on the left side of a page H which is to be a back cover of the binding result as shown in FIG. 46B. Further, when the user is prompted to place originals which are to be inner sheets, a first page C of originals which are to be inner sheets are placed in an orientation and order shown in FIG. 46C on the original feeder 100 in such a manner that the first page C can be at the uppermost position.

Referring next to FIGS. 47 and 48, a description will be given of the position of an image-formed surface of a sheet discharged from the image forming apparatus 10 to the gluing bookbinding apparatus 500.

Figure 47A:
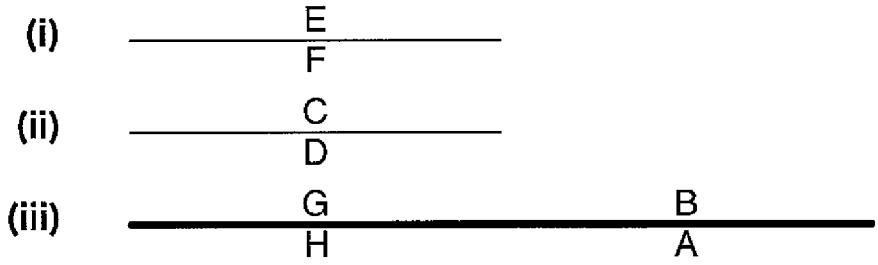
FIG. 47A is a diagram showing the order of sheets discharged from the image forming apparatus to the gluing bookbinding apparatus in the case where the binding direction of a binding result is "right-side binding" in the standard mode or the cover mode.
Figure 47B:
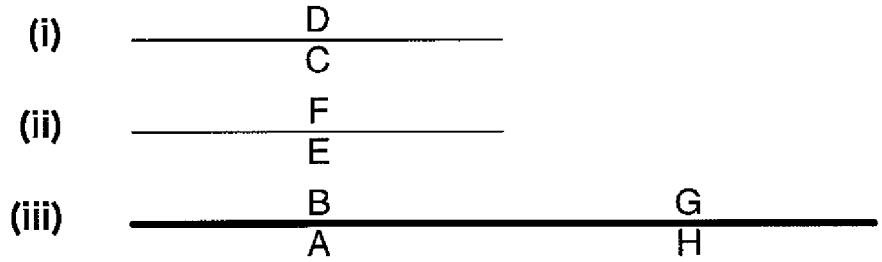
FIG. 47B is a diagram showing the order of sheets discharged from the image forming apparatus to the gluing bookbinding apparatus in the case where the binding direction of a binding result is "left-side binding" in the standard mode or the cover mode.
Figure 48A:
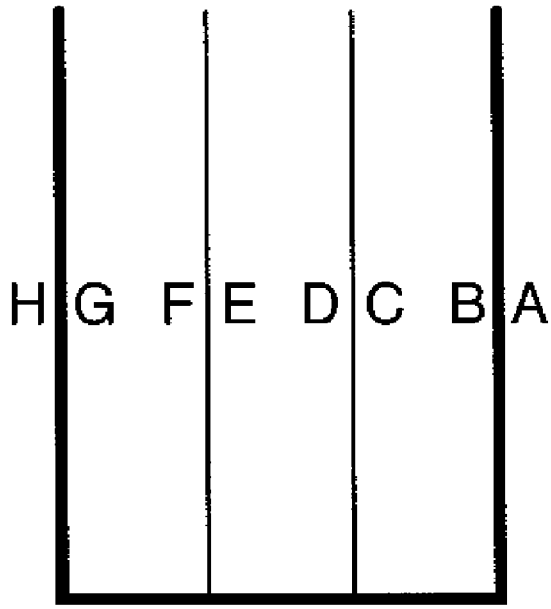
FIG. 48A is a diagram schematically showing a right-side bound booklet that has been bound based on sheets discharged in the order in FIG. 47A.
Figure 48B:
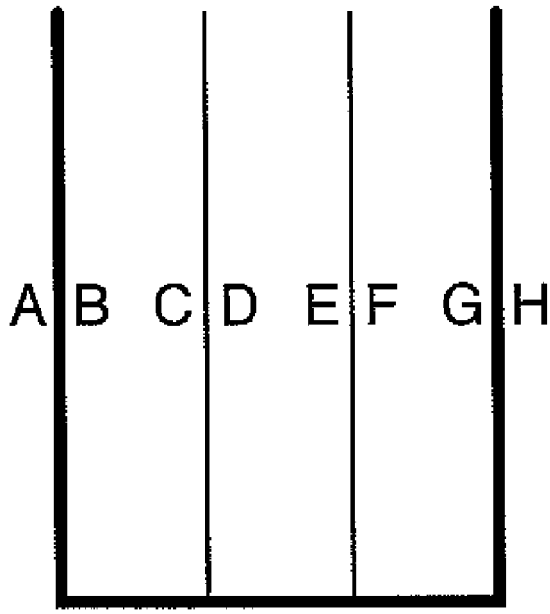
FIG. 48B is a diagram schematically showing a left-side bound booklet that has been bound based on sheets discharged in the order in FIG. 47B.

Originals are placed on the original feeder 100 in the standard mode described above with reference to FIG. 44 or the cover mode described above with reference to FIG. 45, and in the case where the "Right-side binding" is set as the binding direction of a binding result, sheets are discharged from the image forming apparatus 10 to the gluing bookbinding apparatus 500 in an order indicated by (i) to (iii) in FIG. 47A, so that a right-side bound booklet shown in FIG. 48A is formed. In the case where the "Left-side binding" is set as the binding direction of a binding result, sheets are discharged from the image forming apparatus 10 to the gluing bookbinding apparatus 500 in an order indicated by (i) to (iii) in FIG. 47B, so that a left-side bound booklet shown in FIG. 48B is formed.

In the cover mode, a page F lies on an original which is finally read as shown in FIG. 45B, and also, the page F lies on a sheet discharged first from the image forming apparatus 10 as shown in FIG. 47A. For this reason, in the case where the "Right-side binding" is set as the binding direction of a binding result in the cover mode, image formation has to be started after all the placed originals are read.

Figure 47C:
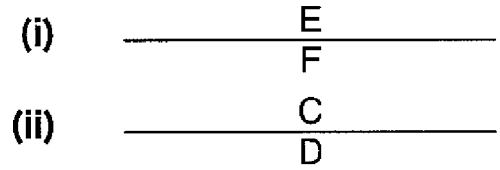
FIG. 47C is a diagram showing the order of sheets discharged from the image forming apparatus to the gluing bookbinding apparatus in the case where the binding direction of a binding result is "right-side binding" in the inserter mode.
Figure 47D:
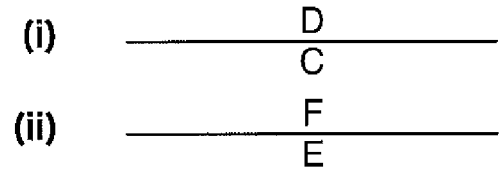
FIG. 47D is a diagram showing the order of sheets discharged from the image forming apparatus to the gluing bookbinding apparatus in the case where the binding direction of a binding result is "left-side binding" in the inserter mode.

In the inserter mode described above with reference to FIG. 46, sheets are discharged from the image forming apparatus 10 in an order indicated by (i) to (ii) in FIG. 47C in the case where the "Right-side binding" is set as the binding direction of a binding result, and sheets are discharged from the image forming apparatus 10 in an order indicated by (i) to (ii) in FIG. 47D in the case where the "Left-side binding" is set as the binding direction of a binding result.

A description will now be given of a glue temperature adjusting mode.

Figure 49:
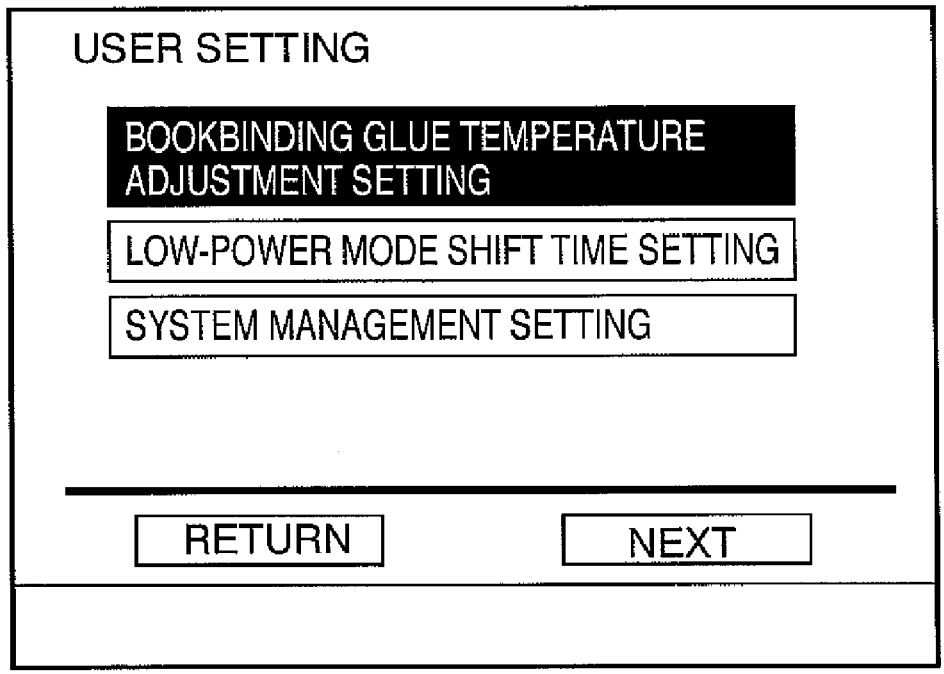
FIG. 49 is a view showing an example of a user setting screen view.

As described above, the gluing bookbinding apparatus 500 has the heater 526, thermistor N2, and bookbinding apparatus controller 501, which adjusts the temperature of glue (temperature control) so that the temperature of glue can be kept inside a predetermined temperature range in which glue can be kept in a liquid state. When the glue temperature adjustment is started or ended can be set through input operation via the liquid crystal display unit 620. Specifically, when the user setting key 617 of the operation display device 600 is depressed, a user setting screen appears as shown in FIG. 49, and a key such as a "Bookbinding glue temperature setting" key for setting the start/end timing of the glue temperature adjustment is displayed in the form of a soft key on the liquid crystal display unit 620. When the "Bookbinding glue temperature adjustment" key is selected, a "Continuous glue temperature adjusting mode" key and an "In-bookbinding glue temperature adjusting mode" key are ready to be selected on a selection screen in FIG. 50.

Figure 50:
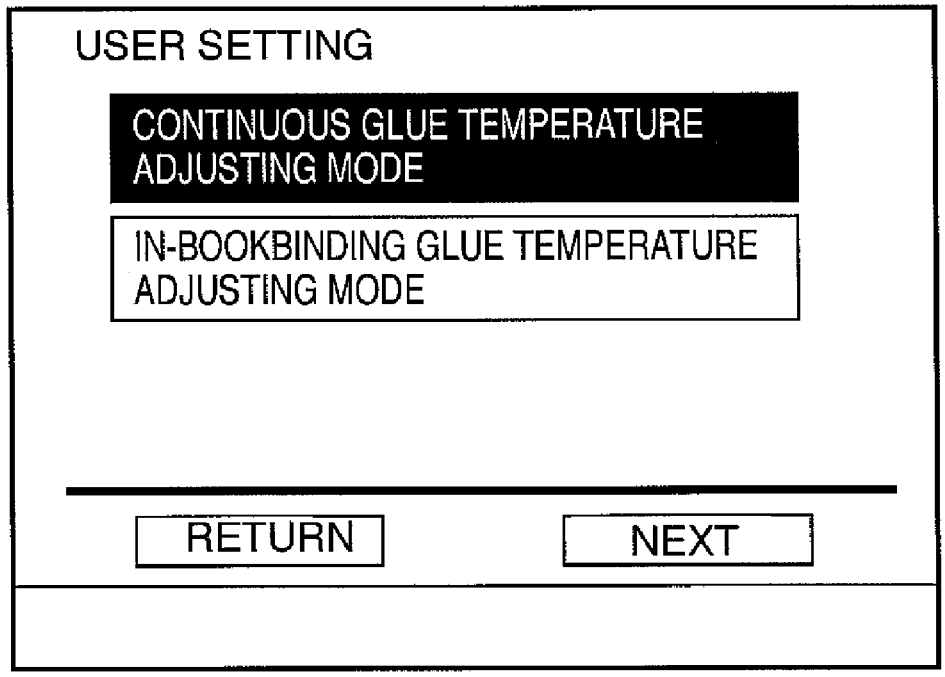
FIG. 50 is a view showing an example of a selection screen view for selecting either of a continuous glue temperature adjusting mode and an in-binding glue temperature adjusting mode.

When the "Continuous glue temperature adjusting mode" is selected on the selection screen in FIG. 50, power supply to the gluing bookbinding apparatus 500 is turned on by the bookbinding apparatus controller 501, and at the same time, the glue temperature adjustment is started. That is, power supply to the heater 526 is turned on. In this mode, the glue temperature adjustment is continuously carried out until power supply to the gluing bookbinding apparatus 500 is turned off.

However, the image forming apparatus 10 is configured to shift from a standby state to a low-power (sleep) mode in which power consumption during standby is suppressed if the printer 350 has not been operating for a predetermined period of time, and therefore, when the image forming apparatus 10 switches to the low-power mode, the gluing bookbinding apparatus 500 also turns off power supply to the heater 526 so as to suppress power consumption during standby and switches to a low-power mode. When the standby return key 618 of the operation display device 600 is depressed in the low-power mode, the gluing bookbinding apparatus 500 returns from the low-power mode into a standby state to wait for the initiation of operation as in the case where power supply to the gluing bookbinding apparatus 500 is turned on. At this time, the gluing bookbinding apparatus 500 starts the glue temperature adjustment.

When the "In-bookbinding glue temperature adjusting mode" is selected on the selection screen in FIG. 50, the glue temperature adjustment is not started at a time point when power supply to the gluing bookbinding apparatus 500 is turned on, but when the bookbinding mode described above (one of the following: the standard mode, the cover mode, and the inserter mode) is selected via the operation display device 600, the bookbinding apparatus controller 501 turns on power supply to the heater 526 to start the glue temperature adjustment. After that, when bookbinding is completed, the bookbinding apparatus controller 501 turns off power supply to the heater 526 to end the glue temperature adjustment.

As described above, the image forming apparatus 10 lies in any of the following states: the operating state in which printing is performed, the standby state in which printing is not performed, and the sleep state in which power consumption during standby for printing is suppressed. When the continuous glue temperature adjusting mode is selected, the bookbinding apparatus controller 501 turns on power supply to the heater 526 to carry out the glue temperature adjustment by heating glue if the image forming apparatus 10 lies in the operating state or the standby state. On the other hand, if the image forming apparatus 10 lies in the sleep state, the bookbinding apparatus controller 501 turns off power supply to the heater 526 to end the glue temperature adjustment by stopping heating glue.

Also, when the in-bookbinding glue temperature adjusting mode is selected, the bookbinding apparatus controller 501 turns on power supply to the heater 526 to carry out the glue temperature adjustment by heating glue if the image forming apparatus 10 lies in the operating state. On the other hand, if the image forming apparatus 10 lies in the standby state or the sleep state, the bookbinding apparatus controller 501 turns off power supply to the heater 526 to end the glue temperature adjustment by stopping heating glue.

Thus, the glue temperature adjustment can be carried out in accordance with the state of the image forming apparatus 10. That is, waiting time until a finished book is output can be reduced and power consumption can be suppressed in an effective manner.

Although in the present embodiment, the start/end timing of the glue temperature adjustment can be set via the operation display device 600 of the image forming apparatus 10, the gluing bookbinding apparatus 500 may be equipped with a glue temperature adjustment setting switch for setting the start/end timing of the glue temperature adjustment.

Figure 51:
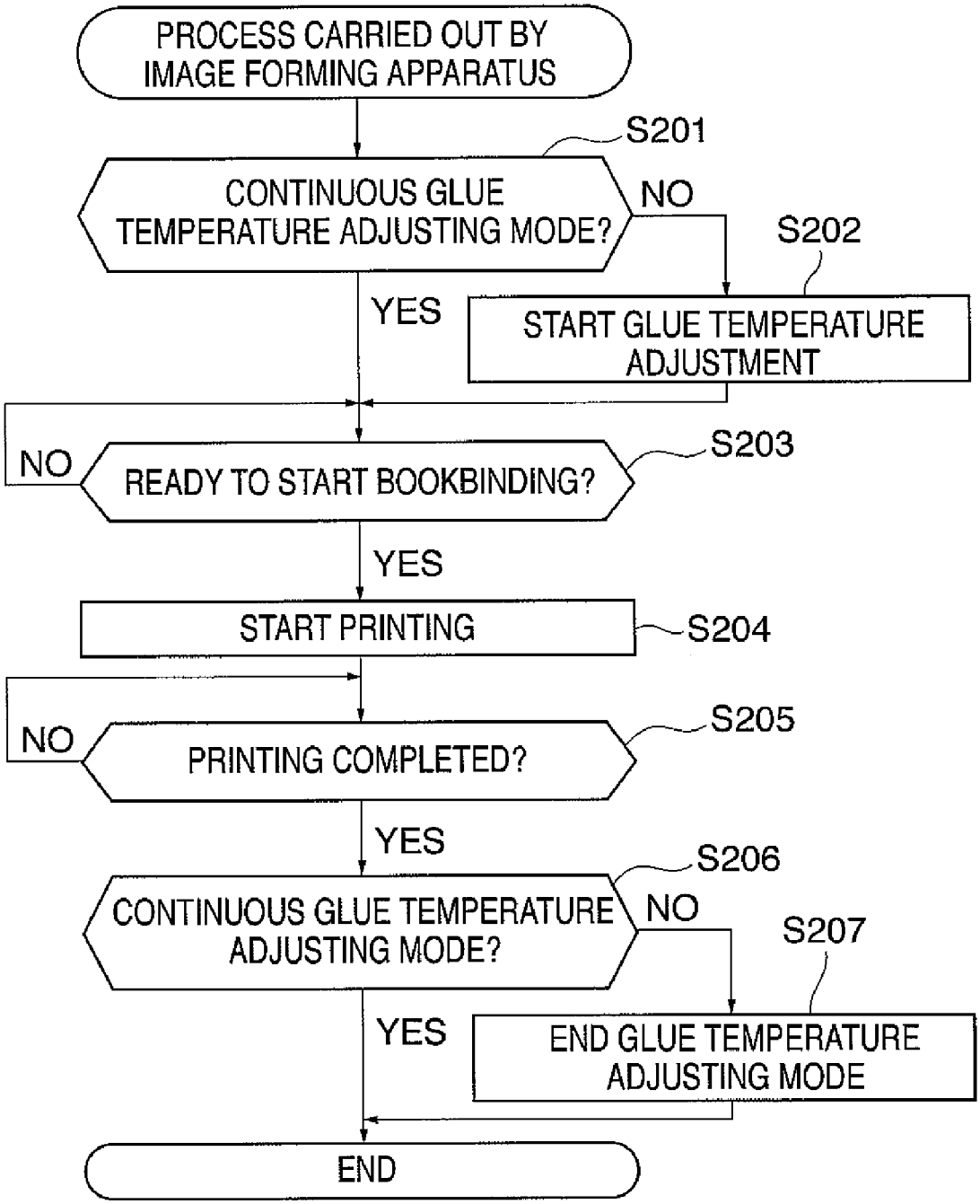
FIG. 51 is a flow chart of a process carried out by the image forming apparatus in the bookbinding mode.

FIG. 51 is a flow chart showing a process carried out by the image forming apparatus 10 in the bookbinding mode. This process is carried out mainly by the CPU circuit section 150.

When the start key 602 is depressed after the bookbinding mode is set, it is determined whether or not the continuous glue temperature adjusting mode has been set for the gluing bookbinding apparatus 500 (step S201).

If it is determined in the step S201 that the continuous glue temperature adjusting mode has not been set, i.e. if the in-bookbinding glue temperature adjusting mode has been set, the gluing bookbinding apparatus 500 is instructed to start the glue temperature adjustment (step S202). The process then proceeds to a step S203.

If it is determined in the step S201 that the continuous glue temperature adjusting mode has been set, this means that the gluing bookbinding apparatus 500 has already carried out the glue temperature adjustment, the process proceeds to the step S203 with the step S202 being skipped.

Next, it is determined whether or not the gluing bookbinding apparatus 500 is ready to start bookbinding (step S203). When the temperature of glue goes into the predetermined temperature range in which glue can be kept in a liquid state after power supply to the heater 526 is turned on, the gluing bookbinding apparatus 500 sends a signal indicating that it is ready to start bookbinding to the image forming apparatus 10, and therefore, the CPU circuit section 150 of the image forming apparatus 10 carries out the determination in the step S203 based on whether or not this signal has been received.

If it is determined in the step S203 that the gluing bookbinding apparatus 500 is ready to start bookbinding, printing is started (step S204).

If it is determined in the step S201 that the continuous glue temperature adjusting mode has been set, the process proceeds to the step S203. The gluing bookbinding apparatus 500, however, is adjusting the temperature of glue and hence immediately sends a signal indicating that it is ready to start bookbinding to the image forming apparatus 10. Thus, in the case where the continuous glue temperature adjusting mode has been set, the image forming apparatus 10 can start printing within a short period of time after the start key 602 is depressed. However, even if the continuous glue temperature adjusting mode has been set, it may take a predetermined period of time before the start of printing in the case where the image forming apparatus 10 has just returned from the low-power mode into the standby state.

When printing is started in the step S204, the completion of printing specified in the bookbinding mode is awaited (step S205).

When it is determined that printing has been completed, it is determined again whether or not the continuous glue temperature adjusting mode has been set for the gluing bookbinding apparatus 500 (step S206).

If it is determined in the step S206 that the continuous glue temperature adjusting mode has not been set, that is, if the in-bookbinding glue temperature adjusting mode has been set, the gluing bookbinding apparatus 500 is instructed to turn off power supply to the heater 526 and end the glue temperature adjustment (step S207), followed by termination of the process.

If it is determined in the step S206 that the continuous glue temperature adjusting mode has been set, the process is terminated. At this time, the glue temperature adjustment is continuously carried out with power supply to the heater 526 of the gluing bookbinding apparatus 500 being kept on.

As described above, according to the present embodiment, it is possible to select either of the continuous glue temperature adjusting mode in which, when power supply to the gluing bookbinding apparatus 500 is turned on, power supply to the heater 526 is turned on to heat glue, and the in-bookbinding glue temperature adjusting mode in which, when binding of a sheet bundle is started, power supply to the heater 526 is turned on to heat glue. Namely, the user can determine whether waiting time until a finished book is output is to be reduced by continuously adjusting the temperature of glue or power consumption is to be suppressed by not adjusting the temperature of glue before bookbinding is started, and therefore it is possible to meet user requests and adapt to usage conditions by a user.

Although in the present embodiment, the continuous glue temperature adjusting mode and the in-bookbinding glue temperature adjusting mode are selected and set via the operation display device 600, the gluing bookbinding apparatus 500 may be provided with an operation display unit via which the continuous glue temperature adjusting mode and the in-bookbinding glue temperature adjusting mode are selected and set.

Although in the present embodiment, glue is applied to a sheet bundle in bookbinding, it goes without saying that an adhesive for use in bookbinding is not limited to glue. An adhesive for use in bookbinding may be any type insofar as it is made from a material which can be heated and melted by the heater 526 and temperature-adjusted.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and function.

This application claims the benefit of Japanese Patent Application No. 2005-252342, filed Aug. 31, 2005, which is hereby incorporated by reference in its entirety.

What is claimed is:

1. A bookbinding apparatus connectable to an image forming apparatus, the bookbinding apparatus comprising:

a heating unit configured to heat an adhesive;

a bookbinding unit configured to bind a sheet bundle with the adhesive melted by said heating unit;

a temperature detecting unit configured to detect a temperature of the adhesive;

a receiving unit configured to receive an instruction from the image forming apparatus to cause said bookbinding unit to bind the sheet bundle;

a selection unit configured to allow a manual selection of one of a first adhesive temperature adjusting mode in which said heating unit heats the adhesive based on the temperature detected by said temperature detecting unit in response to turning on power supply to the bookbinding apparatus even if said receiving unit does not receive the instruction or a second adhesive temperature adjusting mode in which said heating unit heats the adhesive based on the temperature detected by said temperature detecting unit in response to receiving the instruction;

a control unit configured to control said heating unit to heat the adhesive based on the temperature detected by said temperature detecting unit, wherein said control unit controls said heating unit to switch to a low power consumption mode in response to a power mode of the image forming apparatus when the first adhesive temperature adjusting mode is selected, and wherein said control unit controls said heating unit to switch to the low power consumption mode in response to finishing binding the sheet bundle by said bookbinding unit when the second adhesive temperature adjusting mode is selected.

2. A bookbinding apparatus according to claim 1, wherein said bookbinding unit applies the adhesive to one side edge of the sheet bundle and bonds a sheet that covers most of the top and bottom faces of the sheet bundle to the one side edge of the sheet bundle to which the adhesive has been applied, to bind the sheet bundle.

3. A bookbinding system comprising:

an image forming apparatus and a bookbinding apparatus, wherein said bookbinding apparatus comprises:

a sheet stacking unit configured to sequentially receive sheets on which images have been formed by said image forming apparatus and stack the sheets;

a heating unit configured to heat an adhesive;

a temperature detecting unit configured to detect a temperature of the adhesive;

a bookbinding unit configured to bind a sheet bundle comprising a plurality of sheets stacked on said stacking unit with the adhesive melted by said heating unit;

a receiving unit configured to receive an instruction from the image forming apparatus to cause said bookbinding unit to bind the sheet bundle; and a control unit configured to control said heating unit to heat the adhesive based on the temperature detected by said temperature detecting unit, and wherein said image forming apparatus comprises:

an image forming unit configured to form an image on a sheet; and a selection unit configured to allow a manually selection of one of a first adhesive temperature adjusting mode in which said heating unit heats the adhesive in response to turning on power supply to said bookbinding apparatus even if said receiving unit does not receive the instruction or a second adhesive temperature adjusting mode in which said heating unit heats the adhesive in response to receiving the instruction, and wherein said control unit controls said heating unit to switch to a low power consumption mode in response to a power mode of the image forming apparatus when the first adhesive temperature adjusting mode is selected, and wherein said control unit controls said heating unit to switch to the low power consumption mode in response to finishing binding the sheet bundle by said bookbinding unit when the second adhesive temperature adjusting mode is selected.

4. A bookbinding system according to claim 3, wherein said bookbinding unit applies the adhesive to one side edge of the sheet bundle and bonds a sheet that covers most of the top and bottom faces of the sheet bundle to the one side edge of the sheet bundle to which the adhesive has been applied, to bind the sheet bundle.

5. A bookbinding apparatus connectable to an image forming apparatus, the bookbinding apparatus comprising:

a heating unit configured to heat an adhesive;

a bookbinding unit configured to bind a sheet bundle with the adhesive melted by said heating unit;

a temperature detecting unit configured to detect a temperature of the adhesive;

a receiving unit configured to receive an instruction from the image forming apparatus to cause said bookbinding unit to bind the sheet bundle;

a selection unit configured to allow a manual selection of one of a first adhesive temperature adjusting mode in which said heating unit heats the adhesive in response to turning on power supply to the bookbinding apparatus or a second adhesive temperature adjusting mode in which said heating unit heats the adhesive in response to receiving the instruction; and a control unit configured to control:

said heating unit based on the temperature detected by said temperature detecting unit, when the first adhesive temperature adjusting mode is selected, to start heating the adhesive in response to turning on the power supply to the bookbinding apparatus and to maintain heating the adhesive even after finishing binding the sheet bundle, and said heating unit based on the temperature detected by said temperature detecting unit, when the second adhesive temperature adjusting mode is selected, to start heating the adhesive in response to receiving the instruction and to finish heating the adhesive after finishing binding the sheet bundle.

6. A bookbinding system comprising:

an image forming apparatus; and a bookbinding apparatus comprising:

a sheet stacking unit configured to sequentially receive sheets on which images have been formed by said image forming apparatus and stack the sheets;

a heating unit configured to heat an adhesive;

a bookbinding unit configured to bind a sheet bundle comprising a plurality of sheets stacked on said sheet stacking unit with the adhesive melted by said heating unit;

a temperature detecting unit configured to detect a temperature of the adhesive; and a receiving unit configured to receive an instruction from said image forming apparatus to cause said bookbinding unit to bind the sheet bundle, wherein said image forming apparatus comprises:

an image forming unit configured to form an image on a sheet; and a selection unit configured to allow a manual selection of one of a first adhesive temperature adjusting mode in which said heating unit heats the adhesive based on the temperature detected by said temperature detecting unit in response to turning on power supply to said bookbinding apparatus or a second adhesive temperature adjusting mode in which said heating unit heats the adhesive based on the temperature detected by said temperature detecting unit in response to receiving the instruction, and wherein said bookbinding apparatus further comprises a control unit configured to control:

said heating unit based on the temperature detected by said temperature detecting unit, when the first adhesive temperature adjusting mode is selected, to start heating the adhesive in response to turning on the power supply to said bookbinding apparatus and to maintain heating the adhesive even after finishing binding the sheet bundle, and said heating unit based on the temperature detected by said temperature detecting unit, when the second adhesive temperature adjusting mode is selected, to start heating the adhesive in response to receiving the instruction and to finish heating the adhesive after finishing binding the sheet bundle.

* * * * *